US012807393B2

(12) United States Patent
Turenne et al.

(10) Patent No.: US 12,807,393 B2
(45) Date of Patent: Nov. 24, 2026

(54) CONTAINER FOR A PRODUCT

(71) Applicant: THE CLOROX COMPANY, Oakland, CA (US)

(72) Inventors: Marc Turenne, Pleasanton, CA (US); Kira Pyronneau, Pleasanton, CA (US); Matthias Palm, Pleasanton, CA (US); Alexander Peter Schumann, Cambridge (GB); Paul Smitheman, Cambridge (GB); Chris Houghton, Cambridge (GB)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 19/174,041

(22) Filed: Apr. 9, 2025

(65) Prior Publication Data

US 2025/0320052 A1 Oct. 16, 2025

Related U.S. Application Data

(60) Provisional application No. 63/634,179, filed on Apr. 15, 2024.

(51) Int. Cl.

| | |
|---|---|
| ***B65D 83/08*** | (2006.01) |
| ***B65D 1/16*** | (2006.01) |
| ***B65D 43/16*** | (2006.01) |

(52) U.S. Cl.

CPC ..... *B65D 83/0847* (2013.01); *B65D 1/16* (2013.01); *B65D 43/164* (2013.01)

(58) Field of Classification Search

CPC ..... B65D 79/008; B65D 79/0084; B65D 79/0081; B65D 1/0292; B65D 83/0847; B65D 1/16; B65D 43/164; B65D 7/04

USPC ..... 206/449; 220/666

See application file for complete search history.

(56) References Cited

U.S. PATENT DOCUMENTS

| | | | | |
|---|---|---|---|---|
| 5,209,372 A * | 5/1993 | Norwood | B65D 1/0292 | 220/666 |
| 6,012,601 A * | 1/2000 | Van Dam | B65D 7/46 | 220/907 |
| 6,220,475 B1 * | 4/2001 | Nayar | B65D 1/165 | 220/675 |
| 6,364,101 B1 * | 4/2002 | Schultz | A47K 10/3818 | 220/375 |
| D536,262 S * | 2/2007 | Ioannides | D9/776 | |
| D543,845 S | 6/2007 | Ioannides et al. | | |
| D614,049 S | 4/2010 | Diss et al. | | |

(Continued)

*Primary Examiner* — Steven A. Reynolds

(74) *Attorney, Agent, or Firm* — Edell, Shapiro & Finnan, LLC

(57) ABSTRACT

A dispensing canister for wipes includes a container having a body that defines a cavity in which wipes can be located, the body having a first end, a second end opposite to the first end, and an intermediate portion located between the first end and the second end, the body having an outer surface, the first end having a first outer diameter and a part of the intermediate portion having a second outer diameter, the second outer diameter being smaller than the first outer diameter, and the outer surface being tapered from the first outer diameter to the second outer diameter, and a closure mechanism that is removably coupleable to the container, and the closure mechanism can be closed to seal the cavity and opened to enable access to the cavity.

20 Claims, 22 Drawing Sheets

(56) References Cited

U.S. PATENT DOCUMENTS

| | | | | |
|---|---|---|---|---|
| 7,926,243 | B2 * | 4/2011 | Kelley | B65B 61/24 215/381 |
| D637,911 | S | 5/2011 | Macaulay et al. | |
| 8,186,528 | B2 * | 5/2012 | Melrose | B65D 79/0084 215/381 |
| D697,406 | S | 1/2014 | Peacock | |
| D703,048 | S | 4/2014 | Lopez et al. | |
| D703,049 | S | 4/2014 | Riley et al. | |
| 9,382,034 | B2 * | 7/2016 | Baker | B65D 7/34 |
| D769,122 | S * | 10/2016 | Wiggins | D9/500 |
| D771,489 | S | 11/2016 | Azelton et al. | |
| D773,930 | S | 12/2016 | Azelton et al. | |
| D815,531 | S | 4/2018 | Wahl et al. | |
| 9,974,419 | B2 | 5/2018 | Azelton et al. | |
| 10,327,605 | B2 | 6/2019 | Zagar et al. | |
| D887,860 | S | 6/2020 | Hu et al. | |
| D893,299 | S | 8/2020 | Kaye et al. | |
| 10,806,309 | B2 | 10/2020 | Azelton et al. | |
| 11,111,050 | B2 * | 9/2021 | Wiggins | B65D 7/04 |
| D958,665 | S | 7/2022 | Bogert et al. | |
| 11,439,281 | B2 | 9/2022 | Azelton et al. | |
| D981,854 | S | 3/2023 | Berlepsch | |
| D1,003,725 | S | 11/2023 | Schlies | |
| 2001/0035392 | A1 * | 11/2001 | Ota | B65D 1/0223 215/381 |
| 2009/0212004 | A1 * | 8/2009 | Metzger | B65D 43/0212 215/382 |
| 2009/0218349 | A1 * | 9/2009 | Metzger | B65D 81/2015 206/223 |
| 2010/0155359 | A1 * | 6/2010 | Simon | B65D 79/0084 220/675 |
| 2016/0257440 | A1 * | 9/2016 | McIntyre | B29C 49/0411 |
| 2019/0193890 | A1 * | 6/2019 | Palmer | B65D 47/122 |
| 2020/0231335 | A1 * | 7/2020 | Manderfield | B65D 1/10 |
| 2021/0214116 | A1 * | 7/2021 | Palmer | B65D 1/023 |

* cited by examiner

CONTAINER FOR A PRODUCT

CROSS-REFERENCE TO RELATED APPLICATION

This patent application is a non-provisional application of, and claims the benefit of and priority to, U.S. Provisional Patent Application No. 63/634,179, filed Apr. 15, 2024, entitled "CONTAINER FOR A PRODUCT", the entire disclosure of which is hereby incorporated by reference herein.

FIELD OF THE INVENTION

The present invention is directed generally to a container for a product, and more specifically, to a container including a removable lid, such as those used in the dispensing of wipes used in disinfection, cleaning, etc.

BACKGROUND

Wetted wipes including a cleaning formulation impregnated therein are employed in a wide variety of circumstances for disinfecting or cleaning various surfaces. Because the wipes are pre-wetted with a cleaning formulation, it is important that a container in which the wipes are located be sealed so as to prevent the wipes from prematurely drying out. Such wipes may initially be attached to one another, with a line of perforations, rouletting, or similar mechanism by which they may in theory be easily separated from one another, as a lead wipe may be torn from the following wipe as it is pulled from the container.

Often, containers with wetted wipes therein are shipped or transported, and as a result, are subject to external forces applied to the containers. Containers are typically formed of a plastic material. External forces applied to a plastic container often result in damage to the container. In some instances, containers may be stacked upon each other when they are shipping, which causes the upper container or containers to impart a load or force to the tops of lower containers. If such top load forces are large enough, the lower containers may be damaged. Also, lateral external forces may be imparted on the sides of the containers. If a lateral force is large enough, it could result in damage to the container as well. Damage may be in the form of compression of the container or a shortening of the length of the container. Damage may also be in the form of buckling or folding of the side walls of the container when the applied forces are above a particular magnitude. A risk exists that damage such as cracking and/or a closure mechanism becoming unseated may result in any liquid in the container leaking and the wipes in the container prematurely drying out.

Thus, there is a need for an improved container that can support larger loads without suffering damage that causes failure of the container.

SUMMARY

The present disclosure relates to a dispensing canister for wipes that comprises a container including a body that defines a cavity in which wipes can be located, the body having a first end, a second end opposite to the first end, and an intermediate portion located between the first end and the second end, the body having an outer surface, the first end having a first outer diameter and a part of the intermediate portion having a second outer diameter, the second outer diameter being smaller than the first outer diameter, and the outer surface being tapered from the first outer diameter to the second outer diameter; and a closure mechanism that is removably coupleable to the container, wherein the closure mechanism can be closed to seal the cavity and opened to enable access to the cavity.

In one embodiment, the second end has a third outer diameter, and the second outer diameter is less than the third outer diameter, and the outer surface between the second outer diameter and the third outer diameter being tapered.

In an alternative embodiment, the body has a second outer diameter that is smaller than the first outer diameter and the third outer diameter reduces a volume of air in the cavity and improves the container's resistance to having the closure mechanism decouple from the body.

In another embodiment, the container includes a neck portion proximate to the first end of the body, the closure mechanism is coupleable to the neck portion, the neck portion includes a first inner surface that defines an innermost portion of the neck portion and a first inner diameter, the intermediate portion includes a second inner surface that defines an innermost portion of the intermediate portion and a second inner diameter, and the second inner diameter is equal to or greater than the first inner diameter.

In an alternative embodiment, the body of the container has a longitudinal axis and a length extending along the longitudinal axis from the first end to the second end, the length of the body shortens when a sufficient force is applied to the first end, and the body can support a maximum applied force between a shortening of the length by 0.25 inches and a shortening of the length by 0.5 inches.

In another embodiment, the body supports its maximum applied load between a shortening of the length by 0.375 inches and a shortening of the length by 0.45 inches.

In yet another embodiment, the body supports its maximum applied load at a shortening of the length by 0.375 inches.

In an alternative embodiment, the body supports a maximum applied load in a range between 152 lbf and 216 lbf.

In yet another embodiment, the body of the container has a longitudinal axis and a length extending along the longitudinal axis from the first end to the second end, the length of the body shortens when a sufficient force is applied to the first end, and wherein when the length is compressed 0.125 inches, the body can support between 47 lbf and 77 lbf.

In one embodiment, when the length is compressed 0.25 inches, the body can support between 100 lbf and 149 lbf.

In another embodiment, when the length is compressed 0.5 inches, the body can support between 135 lbf and 204 lbf.

In yet another embodiment, the body of the container has a longitudinal axis and a length extending along the longitudinal axis from the first end to the second end, the length of the body shortens when a sufficient force is applied to the first end, and wherein over a range of the length of the body shortening between 0.0 inches and 0.5 inches in response to an applied force, the applied force that is supported by the body increases from 0 lbf to a maximum load point and then decreases without increasing a second time prior to the length of the body shortening 0.5 inches.

In one embodiment, a ratio of the first outer diameter of the body to the second outer diameter of the body is 1.12.

In another embodiment according to the present disclosure, a dispensing canister for wipes comprises a container including a body that defines a cavity in which wipes can be located, the body including a first end having a first outer diameter; a second end opposite to the first end, the second end having a second outer diameter; an intermediate portion located between the first end and the second end, part of the intermediate portion having a third outer diameter, the third outer diameter being smaller than the first outer diameter and smaller than the second outer diameter; and an outer surface, the outer surface being tapered between the first outer diameter and the third outer diameter such that an outer diameter of the body decreases from the first outer diameter to the third outer diameter, and the outer surface being tapered between the second outer diameter and the third outer diameter such that an outer diameter of the body decreases from the second outer diameter to the third outer diameter; and a closure mechanism that is removably coupleable to the container, wherein the closure mechanism can be closed to seal the cavity and opened to enable access to the cavity.

In an alternative embodiment, the body has a longitudinal axis and a length extending along the longitudinal axis from the first end to the second end, the length of the body shortens when a sufficient force is applied to the first end of the body, and the body can support a maximum applied force between a shortening of the length by 0.25 inches and a shortening of the length by 0.5 inches.

In another embodiment, the body supports its maximum applied load between a shortening of the length by 0.36 inches and a shortening of the length by 0.46 inches.

In yet another embodiment, the body supports a maximum applied load in a range between 139 lbf and 217 lbf.

In another embodiment according to the present disclosure, a dispensing canister for wipes comprises a container including a body that defines a cavity in which wipes can be located, the body including a first end having a first outer diameter; a second end opposite to the first end, the second end having a second outer diameter; an intermediate portion located between the first end and the second end, part of the intermediate portion having a third outer diameter, the third outer diameter being smaller than the first outer diameter and smaller than the second outer diameter; a longitudinal axis extending from the first end to the second end, the body having a length extending along the longitudinal axis, the length of the body shortening when a sufficient force is applied to the first end of the body; and an outer surface, the outer surface being tapered between the first outer diameter and the third outer diameter such that an outer diameter of the body decreases from the first outer diameter to the third outer diameter; and a closure mechanism that is removably coupleable to the container, wherein the closure mechanism can be closed to seal the cavity and opened to enable access to the cavity.

In one embodiment, the body can support a maximum applied force between a shortening of the length by 0.25 inches and a shortening of the length by 0.5 inches.

In another embodiment, the container includes a neck portion proximate to the first end of the body, the closure mechanism is coupleable to the neck portion, the neck portion includes a first inner surface that defines an innermost portion of the neck portion and a first inner diameter, the intermediate portion includes a second inner surface that defines an innermost portion of the intermediate portion and a second inner diameter, and the second inner diameter is equal to or greater than the first inner diameter.

Further features and advantages of the present invention will become apparent to those of ordinary skill in the art in view of the detailed description of preferred embodiments below.

DETAILED DESCRIPTION

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

When a load is applied to the top end of a canister, the body of the canister absorbs and supports the applied force. As an applied force increases, the canister body may begin to deform. Such deformation may appear in the shortening of the length of the canister body as well as by the shape of the canister body changing. For example, the canister body shape may change by folding onto itself and/or by forming creases therein. Ideally, the deformation of the canister body is minimized so that the integrity of the canister body is maintained as much as possible. If a canister body is deformed too much, it will buckle and may form cracks in the canister body through which a liquid in the canister body may leak.

To address the concerns relating to deformation of the canister body, there are several characteristics that can be changed for different canisters according to the present disclosure. A characteristic that can be changed is the shape of the canister body. Another characteristic that can be changed is the selection of the plastic material used for the canister body.

Figure 1:
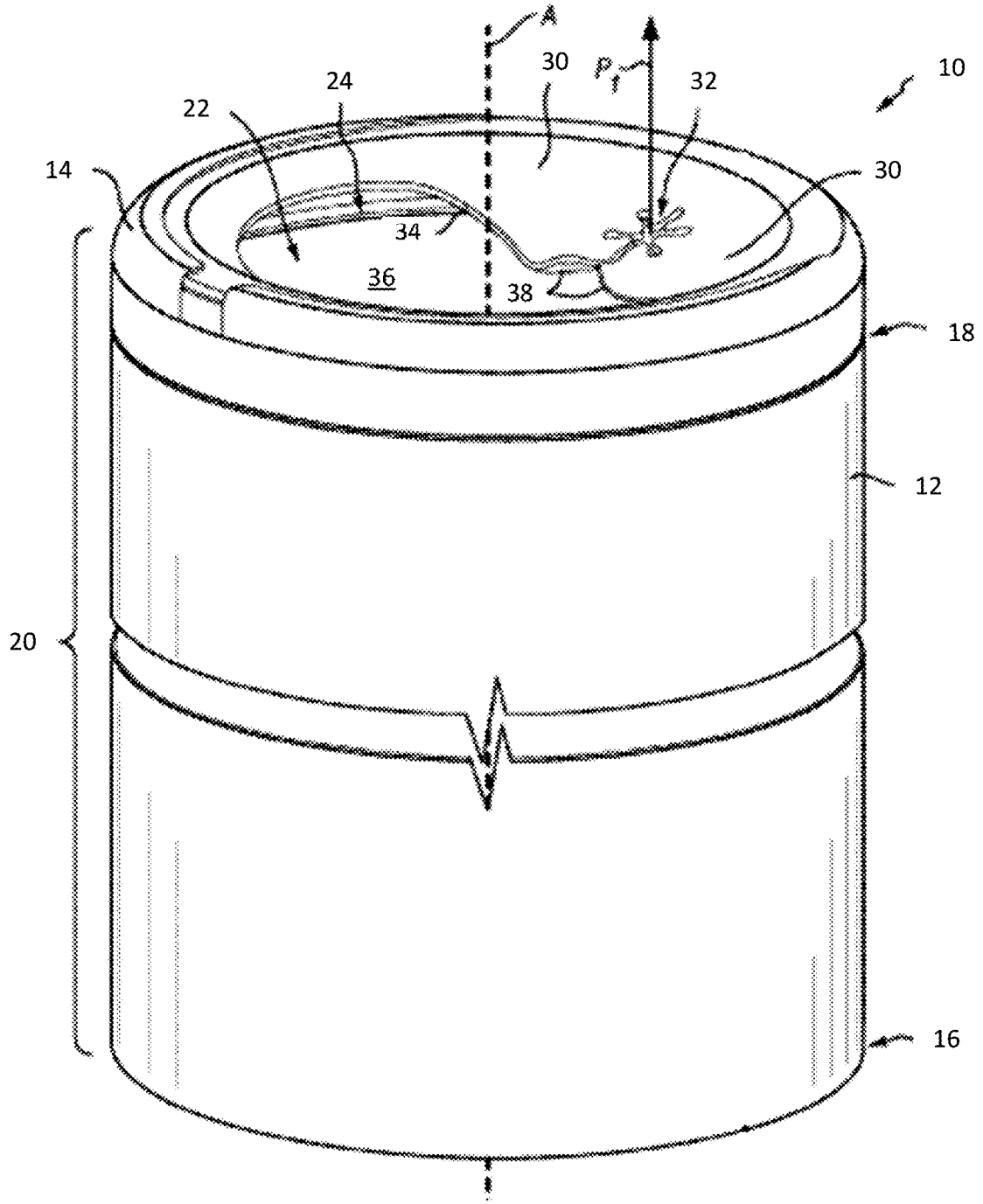
FIG. 1 (Prior Art)
FIG. 1 is a perspective view of an exemplary conventional dispensing container.
Figure 2:
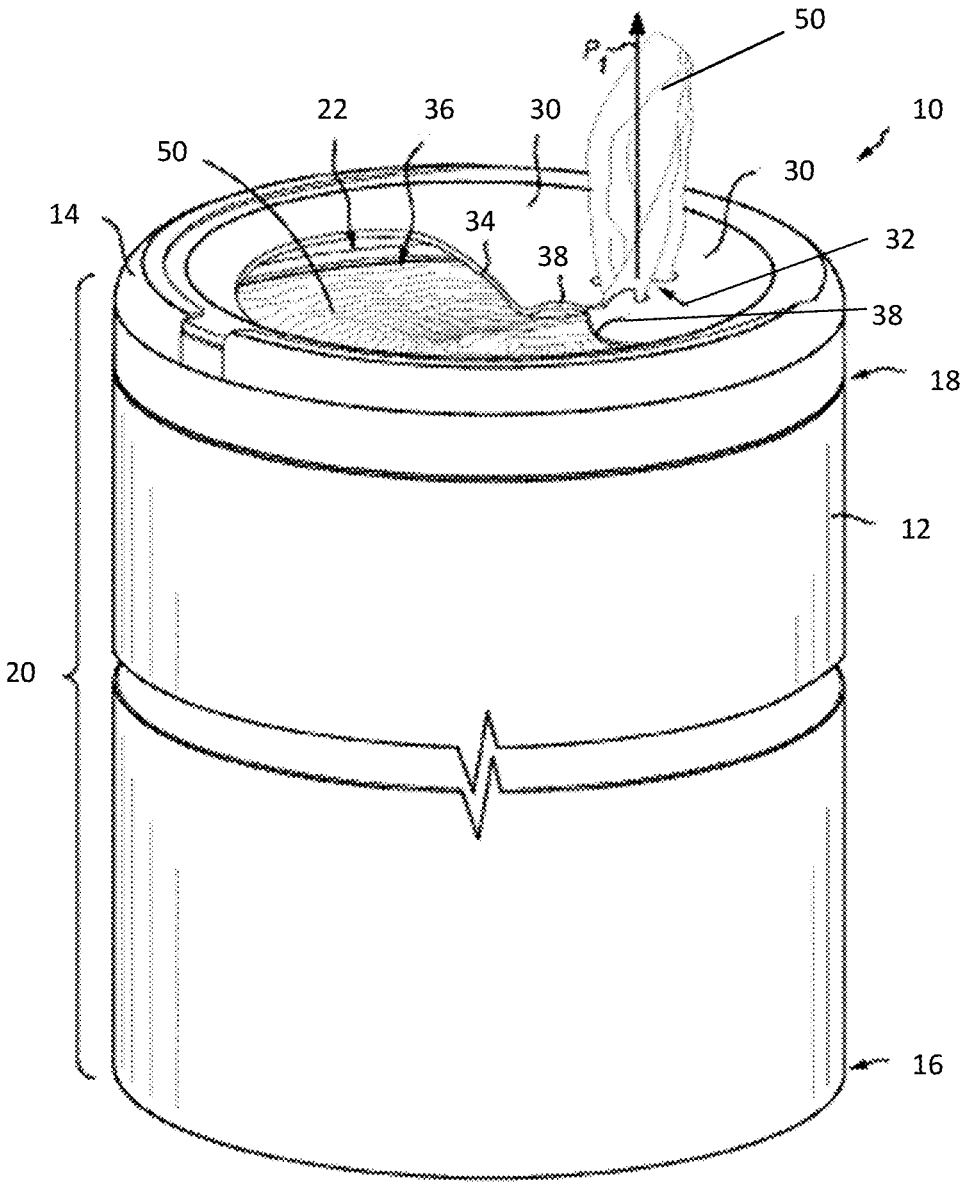
FIG. 2 (Prior Art)
FIG. 2 is a perspective view of the conventional dispensing container illustrated in FIG. 1 with a wipe threaded in the gripping channel ready to be dispensed.

Referring to FIGS. 1 and 2, different views of exemplary conventional, prior art, containers are illustrated. An exemplary removable lid 14 for use with a container body 12 to form a container or canister 10 that may form a portion of a wipes dispenser or system is illustrated. The removable lid 14 may include a hinged cover (not shown), which closes over landing member 30 and secondary aperture 36. Longitudinal axis A is shown extending up and down from the center of the container body 12. Container body 12 and removable lid 14 of wipes dispenser 10 form an interior region 22, e.g., within hollow container body 12, capped by removable lid 14. As shown in FIG. 2, within interior region 22 is a plurality of wipes or portions of a nonwoven rolled product 50 that are interconnected such that pulling on a lead end of a lead wipe of the plurality of wipes upward along the direction of arrow "P1" causes a following wipe of the plurality of wipes to also be pulled and follow the lead wipe. Wipes 50 may be wound in the shape of a donut, as seen in FIG. 2.

A container aperture 24 may be defined through an exterior wall of container 20. For example, container body 12 may be generally cylindrical in shape, with a hollow interior region 22. The bottom 16 of container body 12 may be closed, while the top 18 of container body 12 may be open, so as to define container aperture 24. A portion of container aperture 24 may be covered by removable lid 14. The container 20 may be a soft or rigid material.

Removable lid 14 may include landing member 30 which is formed from a rigid material. Rigid landing member 30 is part of lid 14 and covers a portion of container aperture 24 by extending from the top rim of container body 12 inwardly toward a middle of interior region 22 of container 20. Landing member 30 may include one or more features configured to enhance the ability of a user to pull wipes from container in a substantially vertical direction, while limiting any tendency of the interconnected wipes to "rope," to disengage from gripping channel 32 and fall back into container 20, or both. In landing member 30, a plurality of fingers 38 may be defined.

Such an angled or downwardly curved configuration of landing member 30 advantageously decreases any tendency of the interconnected wipes 50 to "rope" as they are pulled from wipes dispenser 10, through a gripping channel 32 in landing member 30, particularly where the wipes 50 are pulled in a generally vertical orientation, as users are prone to do so.

In one embodiment, there is a gripping channel 32 in landing member 30 that communicates with interior 22 of container 20 through container aperture 24 such that individual wipes of the plurality of wipes are removed from container 20 by being pulled through gripping channel 32. Gripping channel 32 is configured to separate a lead wipe from a following wipe as the lead wipe is pulled through gripping channel 32. As illustrated in FIGS. 1-2, gripping channel 32 may be star or flower shaped, including a plurality of arms or petals that are surrounding a central aperture through which a lead wipe may be pulled. Gripping channel 32 may be in communication with an outer edge 34 of landing member 30, including a threading portion between outer edge 34 and the central aperture of channel 32, which allows a user to thread a lead wipe into the central aperture through threading portion. In other embodiments of the invention, a container aperture may be used without a gripping channel and the container aperture or other suitable dispensing feature may be configured to separate the lead wipe from the following wipe as the lead wipe is pulled away from the container.

Exemplary canisters having different features are disclosed in the following patents: U.S. Design Pat. No. D771,489, issued Nov. 15, 2016, entitled "Wipes Dispenser Container Lid"; U.S. Design Pat. No. D773,930, issued Dec. 13, 2016, entitled "Lid With An Orifice"; U.S. Pat. No. 9,974,419, issued May 22, 2018, entitled "Disinfecting Wipes Dispenser"; U.S. Pat. No. 10,327,602, issued Jun. 25, 2019, entitled "Disinfecting Wipes Dispenser"; U.S. Pat. No. 10,806,309, issued Oct. 20, 2020, entitled "Disinfecting Wipes Dispenser"; and U.S. Pat. No. 11,439,281, issued Sep. 13, 2022, entitled "Disinfecting Wipes Dispenser". The entire disclosure of each of the six patents identified in this paragraph is incorporated herein by reference in its entirety for all purposes.

Figure 3:
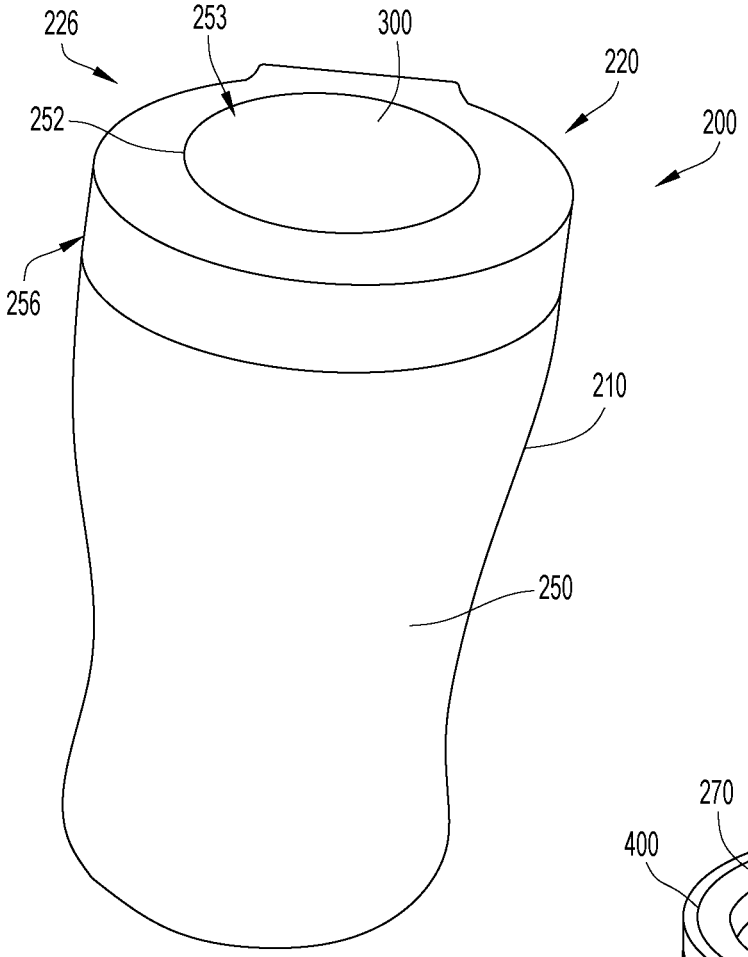
FIG. 3 is a perspective view of an embodiment of a dispensing container according to the present invention.
Figure 4:
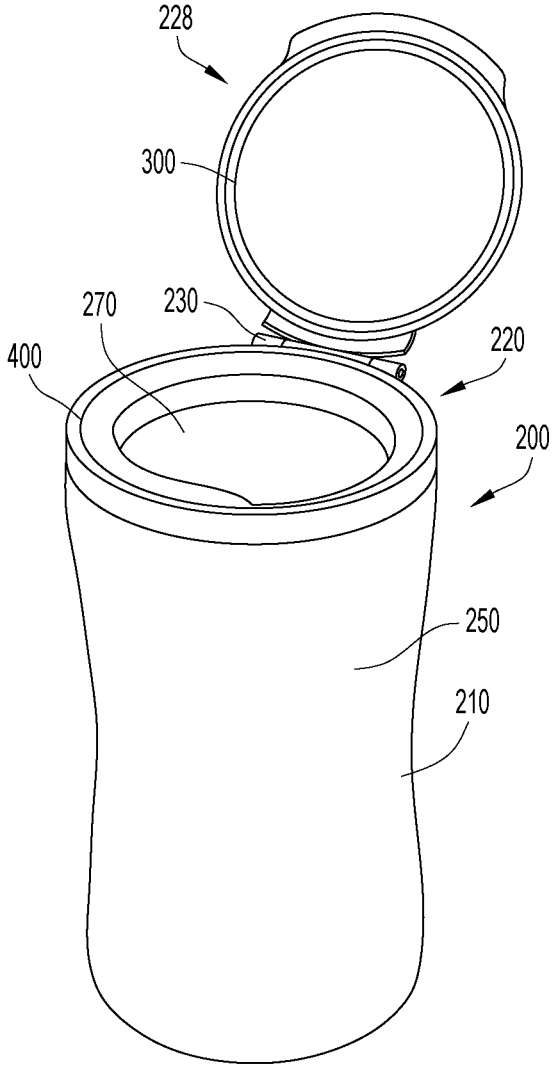
FIG. 4 is a perspective view of the dispensing container illustrated in FIG. 3 with its lid in an opened position.
Figure 5:
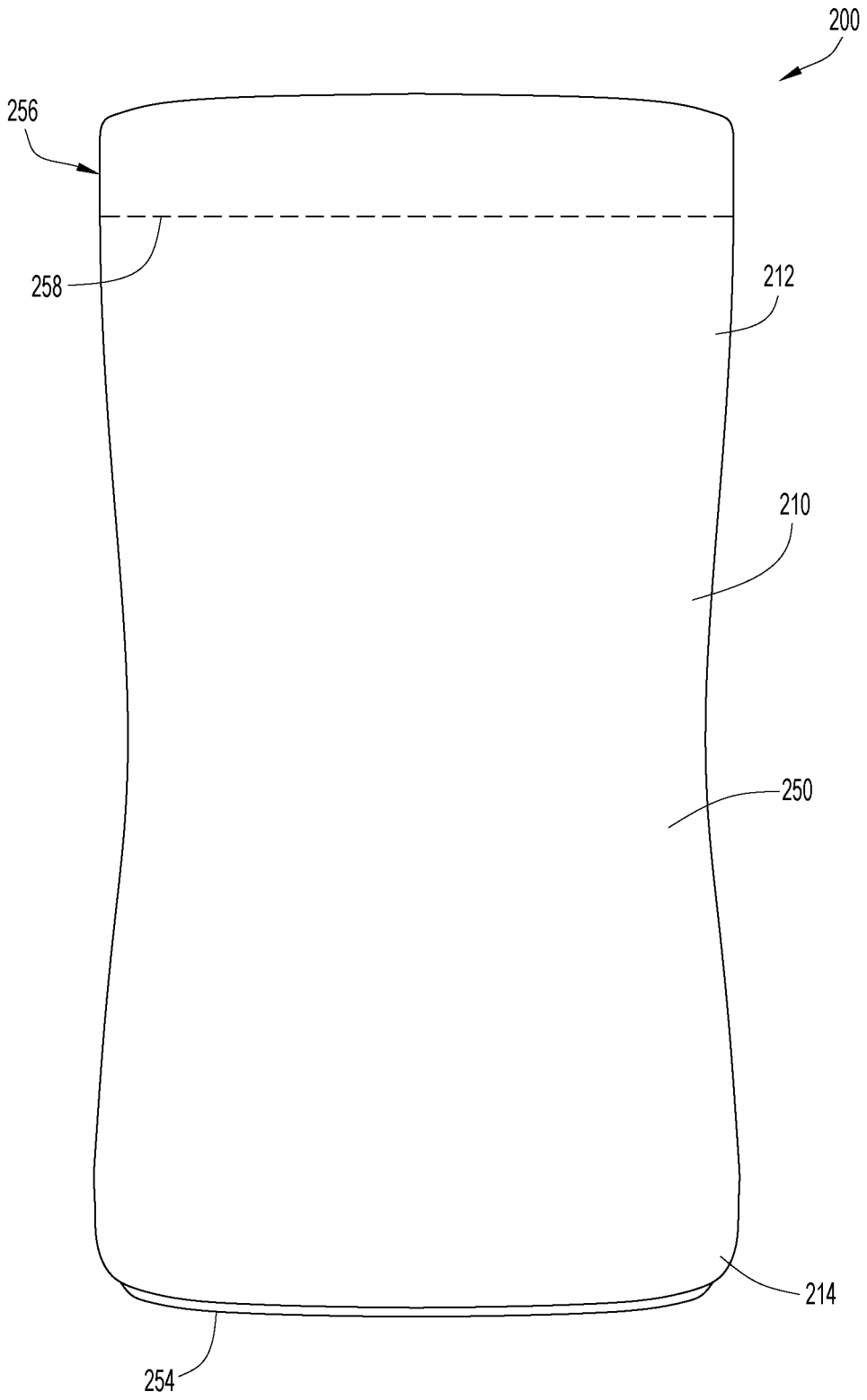
FIG. 5 is a front view of the dispensing container illustrated in FIG. 3.

Turning to FIGS. 3-5, an embodiment of a dispensing canister according to the present invention is illustrated. In this embodiment, the dispensing canister 200 has a body 210 that has an upper end 212 and a lower end 214 (see FIG. 5). Coupled to the upper end 212 of the body 210 is a closure mechanism 220 that can be manipulated between a closed configuration and an opened configuration. The closure mechanism 220 includes a base 400 that is removably coupled to the body 210, and a lid 300 that is pivotally coupled to the base 400 via a hinge 230. The lid 300 can be moved to a closed position 226 (see FIG. 3) and an opened position 228 (see FIG. 4). As a result, the closure mechanism 220 has a closed configuration (see FIG. 3) in which the contents of the canister 200 are sealed, and an opened configuration (see FIG. 4) in which the contents of the canister 200 are accessible and removable. In this embodiment, a roll of wipes 270 are disposed in the canister 200.

In this embodiment, the canister 200 includes an outer layer or wrap of film 250. The film 250 extends from an upper end 252 (see FIG. 3) to a lower end 254 (see FIG. 5). The upper portion of the film 250 has been formed around the upper end of the canister 200 so that the film upper end 252 defines an opening 253 that has a smaller diameter than the diameter of the closure mechanism 220. As a result, the film 250 wraps up and over the corners of the upper end of the canister 200. In this embodiment, the pattern shown on the lower portion 140 is visible and provides noticeable texture to an end user even through the film 250.

To facilitate the opening and use of the canister 200, the film 250 includes a removable or separable portion 256 at the upper portion of the film 250. Referring to FIGS. 3 and 5, the upper removable portion 256 is illustrated. In one implementation, the upper removable portion 256 connected to the remainder of the film 250 by perforations 258. In other implementations, a different separable connection structure can be used to allow removable portion 256 to be decoupled and removed from the rest of the film 250.

Figure 6A:
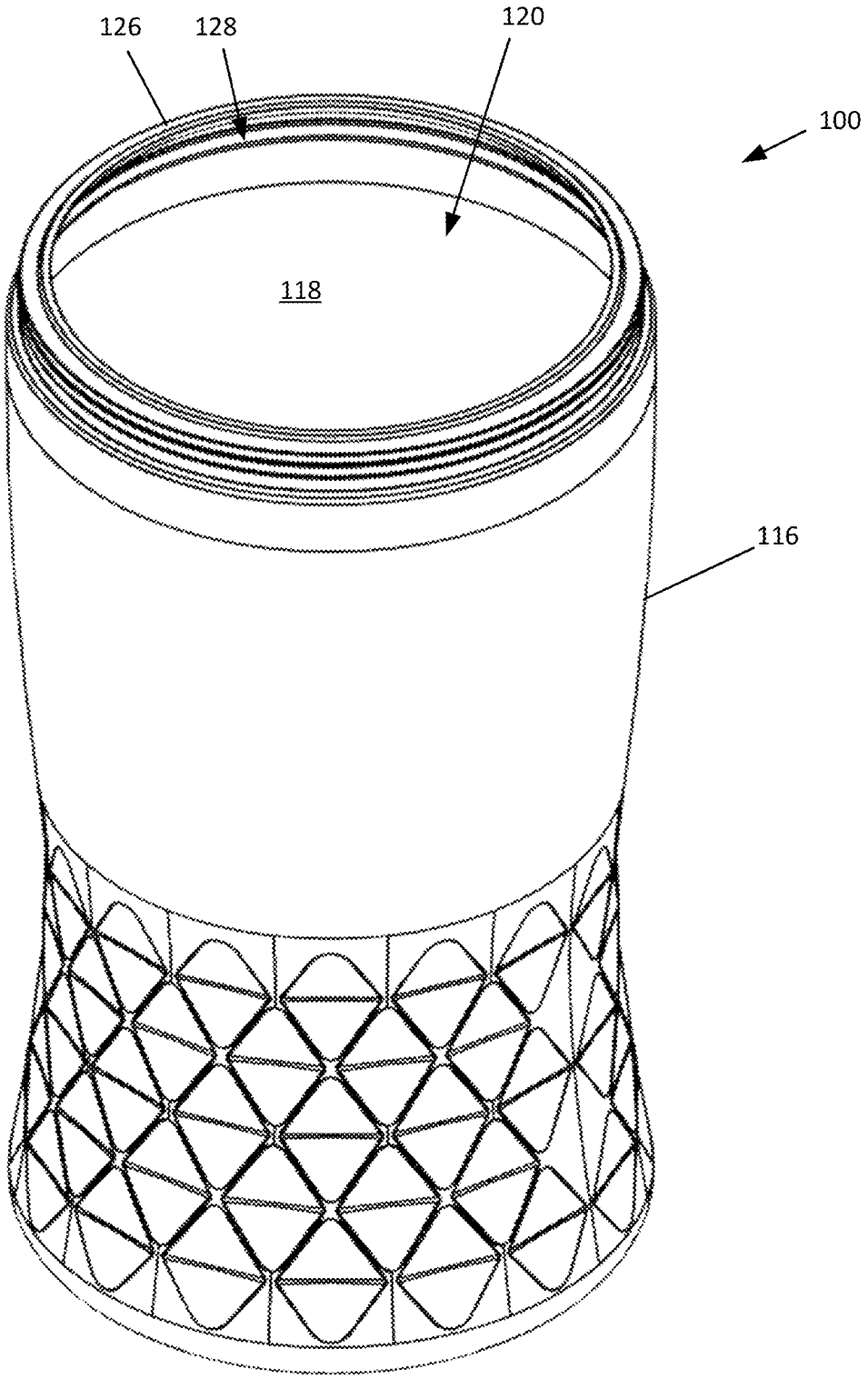
FIG. 6A is a perspective view of the body of the dispensing container illustrated in FIG. 3 with the film and the closure mechanism removed.
Figure 6B:
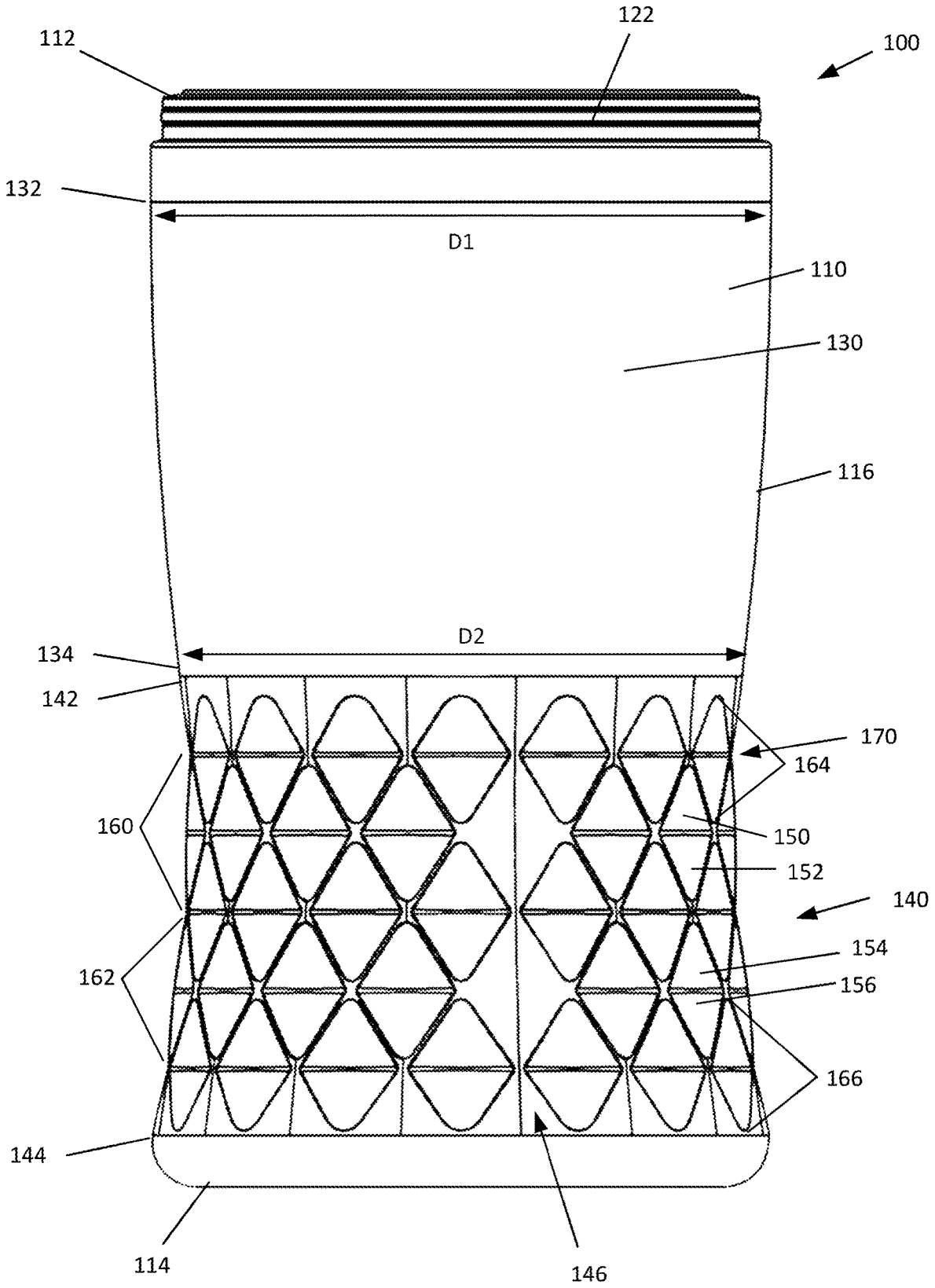
FIG. 6B is a front view of the body illustrated in FIG. 6A.
Figure 6C:
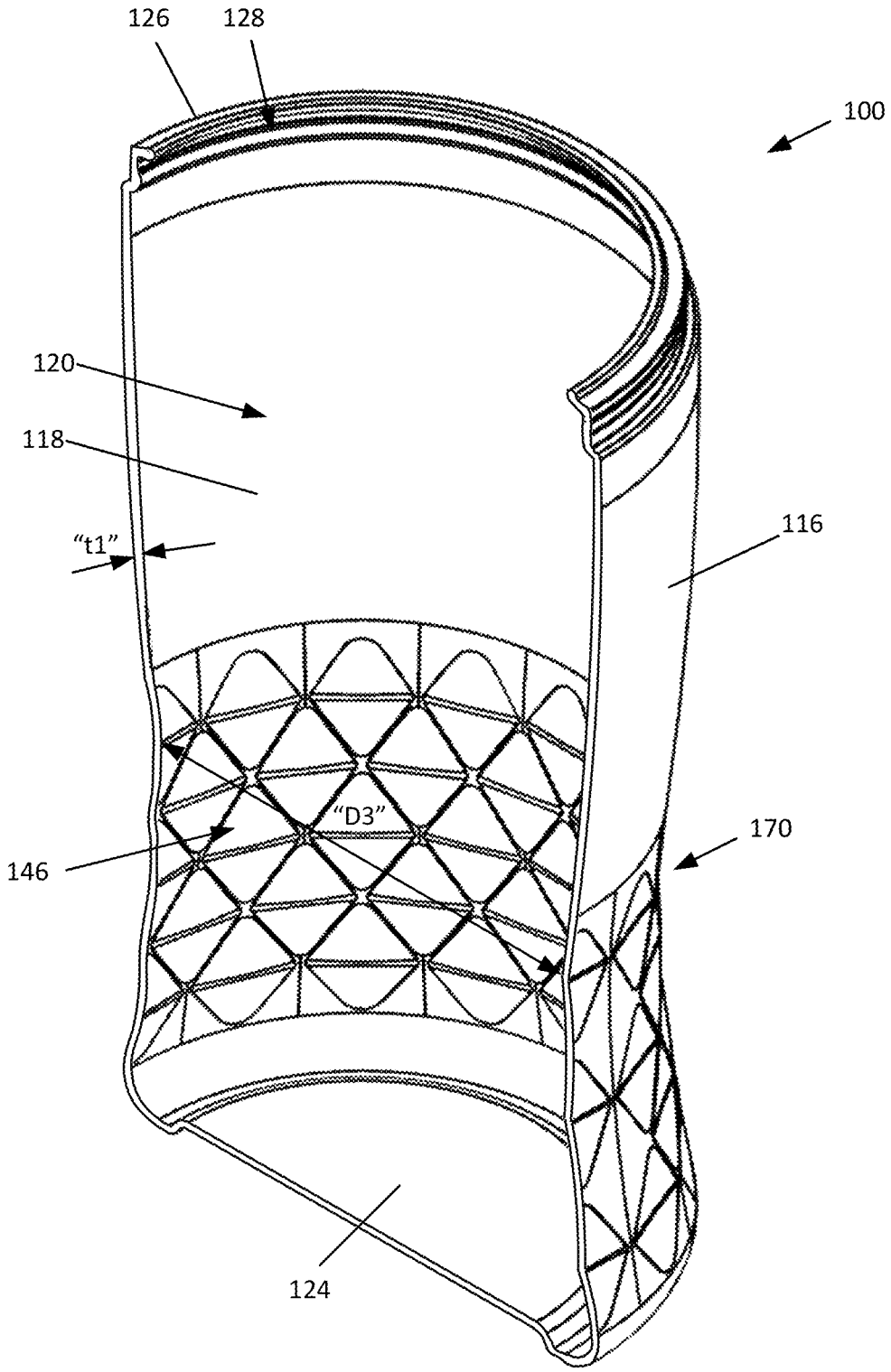
FIG. 6C is a cross-sectional perspective view of the body illustrated in FIG. 6A.

Turning to FIGS. 6A-6C, different views of an embodiment of a canister according to the present invention are illustrated. In this embodiment, canister 100 includes a body 110 with an upper end 112 and a lower end 114 (see FIG. 6B). The body 110 has an outer surface 116 and an inner surface 118. The inner surface 118 defines an inner cavity or receptacle 120 in which a product, such as a roll of wipes, may be placed.

The lower end 114 of the body 110 includes an inner bottom surface 124 (see FIG. 6C) which defines the bottom of the cavity 120. Proximate to the upper end 112, the body 110 includes a series of threads 122 (see FIG. 6B) that can be engaged by threads on the base 400 to removably couple the closure mechanism 220 to the body 110 of the canister 100. The series of threads 122 are located on a neck section or neck portion that is at the upper end 112 of the body 110. As shown in FIGS. 6A and 6B, also at the upper end 112 is an inner edge 126 that defines an opening 128 through which the cavity 120 can be accessed.

Referring to FIG. 6B, the body 110 of the canister 100 is discussed. The body 110 has an upper portion 130 and a lower portion 140. In this embodiment, the upper portion 130 extends from an upper end 132 to a lower end 134. The outer diameter of the upper portion 130 varies between its upper end 132 and its lower end 134. The outer diameter at the upper end 132 is shown as diameter D1, which is larger than the outer diameter at the lower end 134, which is diameter D2. The upper portion 130 has a tapered configuration from the upper end 132 to the lower end 134.

The lower portion 140 of the body 110 extends from an upper end 142 to a lower end 144. In this embodiment, the outer diameter of the upper end 142 of the lower portion 140 is approximately the same as the outer diameter of the lower end 144 of the lower portion 140. However, unlike the outer surface of upper portion 130, which is generally continuous and smooth, the lower portion 140 has a textured configuration 146 which is visible on the outer surface and the inner surface of the lower portion 140. The textured configuration 146 includes a series of shaped projections formed therein. In this embodiment, the lower portion 140 includes numerous diamond-shape projections formed therein that are visible in the outer surface and in the inner surface of the lower portion 140. Each of the diamond-shaped projections is formed by a pair of triangular-shaped faceted projections or facets. Each pair of triangular-shaped facets includes facets that are oriented in opposite directions. Facets 150 and 152 form a diamond-shaped pair of facets. Similarly, facets 154 and 156 form a diamond-shaped pair of facets.

The diameter of the lower portion 140 varies and is determined by the different facet pairs. There are two types of facet pairs formed in the lower portion 140. Due to the diamond-shapes of the facet pairs, adjacent diamond-shaped facet pairs are offset from each other.

One type of facet pairs is shown by facet pair 160 and facet pair 162. Facet pair 160 defines a straight outer surface extending from the upper end of facet pair 160 to the lower end of facet pair 160. Similarly, facet pair 162 defines a straight outer surface extending from the upper end of facet pair 162 to the lower end of facet pair 162. As shown, the diameter of the lower portion 140 can vary along facet pairs 160 and 162 along a straight line.

The other type of facet pairs is shown by facet pair 164 and facet pair 166. The triangular-shaped facets that form facet pair 164 do not form a straight outer surface because the facets are oriented at an angle less than 180 degrees relative to each other. As a result, the diameter of the lower portion 140 along facet pair 164 does not change linearly. Similarly, the triangular-shaped facets that form facet pair 166 do not form a straight outer surface either.

The structure of the lower portion 140 with the different facets and the offset pattern of varying diamond-shaped facet pairs strengthens the lower portion of the canister 200 as compared to conventional canisters that have a continuous smooth surface for the upper portion and the lower portion of the body of the canister. When canisters 200 are stacked upon each other, or have an external force applied on the top of the canister 200, the faceted lower portion 140 of canister 200 increases the overall strength of the canister body 210, which reduces the likelihood of crushing or collapsing occurring in the canister body 210.

As shown in FIGS. 6B and 6C, the body 110 of the canister 100 has a portion 170 that has the narrowest inner diameter of the body 110, which also has the narrowest outer diameter of the body 110. The benefit of the narrowest inner diameter of the container body 110 is described in greater detail below. In this embodiment, the wall of the body 110 has a thickness "t1". The inner surface 118 defines a changing inner diameter of the body 110 along the length of the body 110. At the narrowest point, the inner diameter at the narrowest portion 170 is shown by the diameter "D3". The waisted or hourglass shape of the body 110 improves the ability of the body 110 to absorb externally applied forces and control any potential damage to the body 110. The narrowest portion can be referred to alternatively as a narrowed portion.

Figure 7:
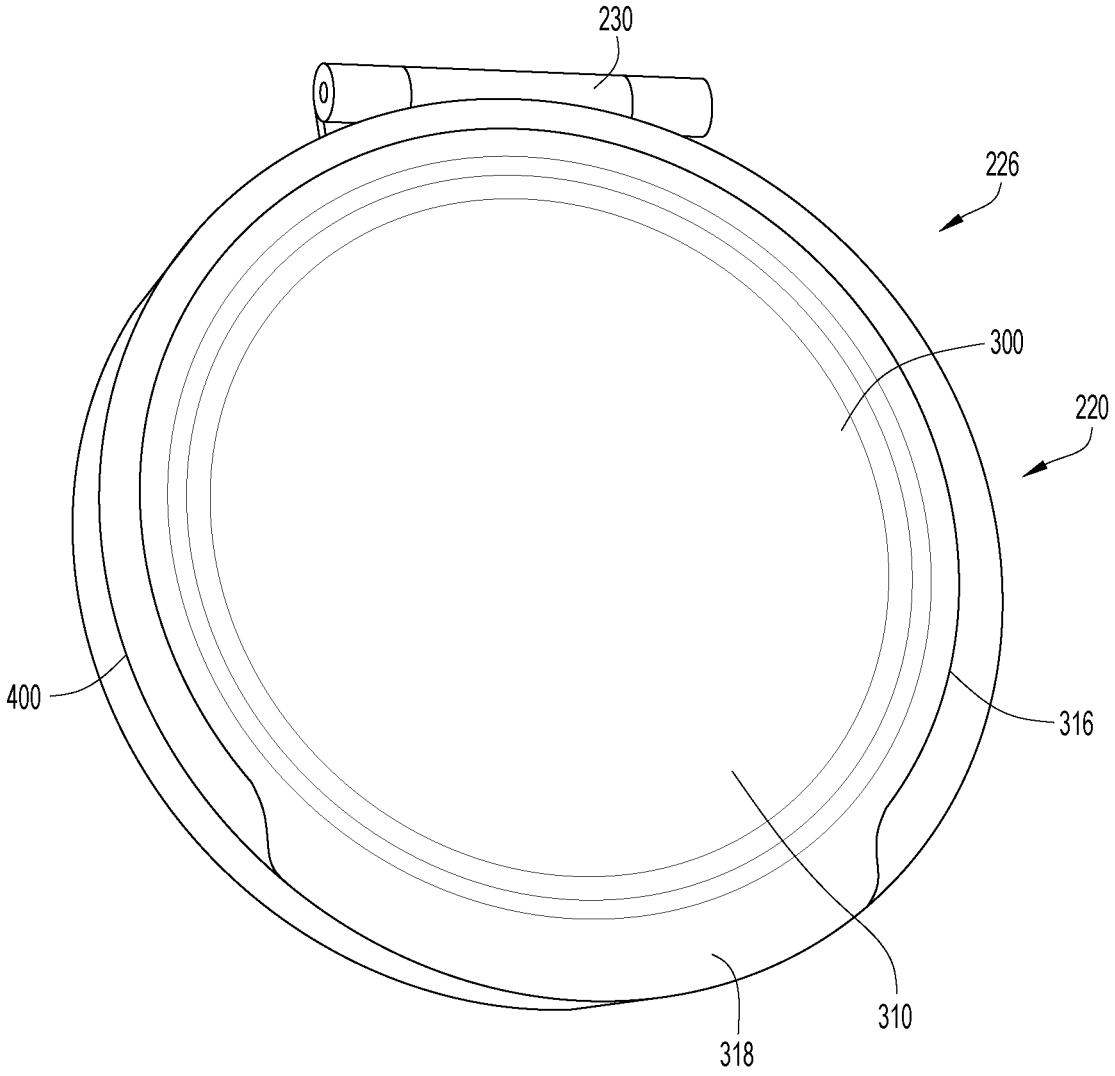
FIG. 7 is a perspective view of the removable closure mechanism of the dispensing container illustrated in FIG. 3 in a closed configuration.
Figure 8:
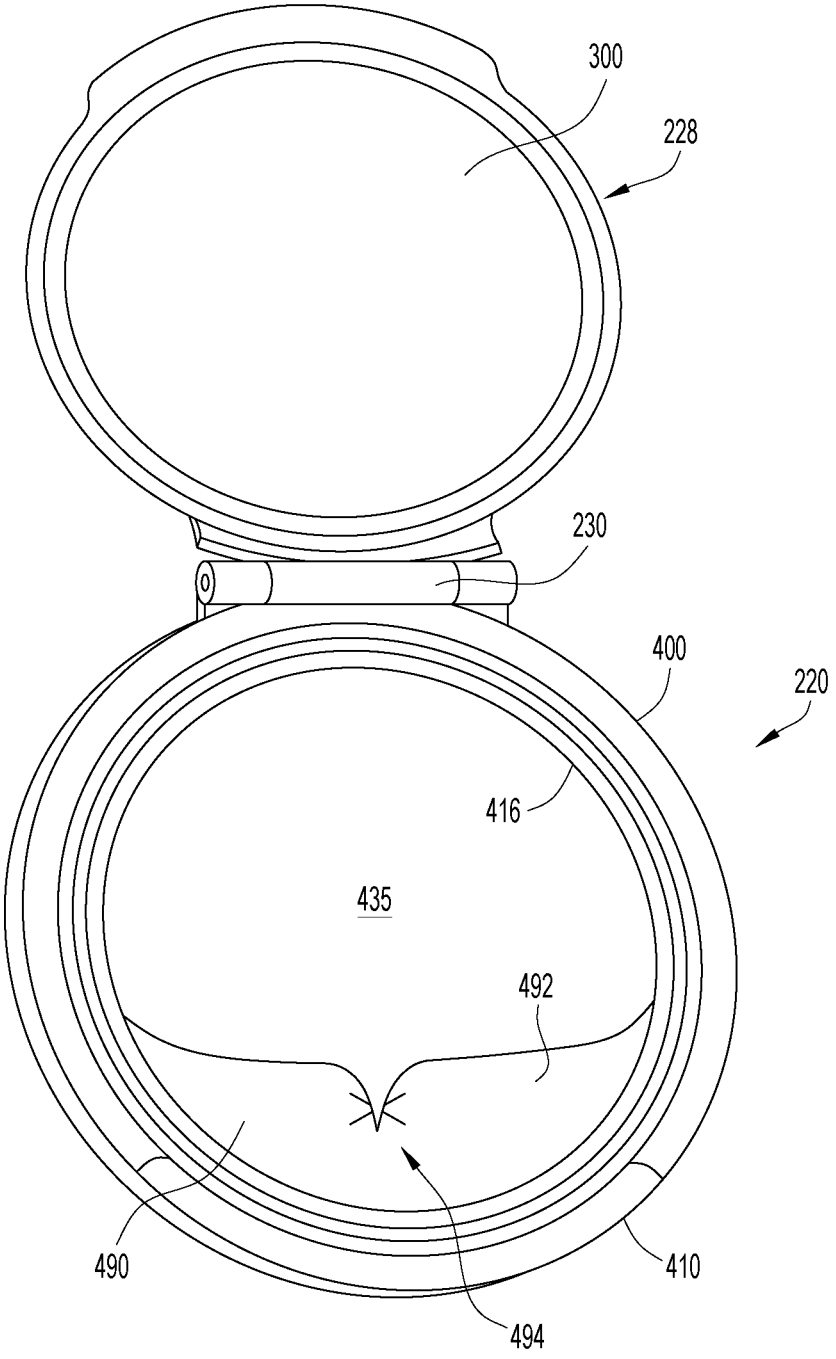
FIG. 8 is a perspective view of the removable closure mechanism of the dispensing container illustrated in FIG. 3 in an opened configuration.
Figure 9:
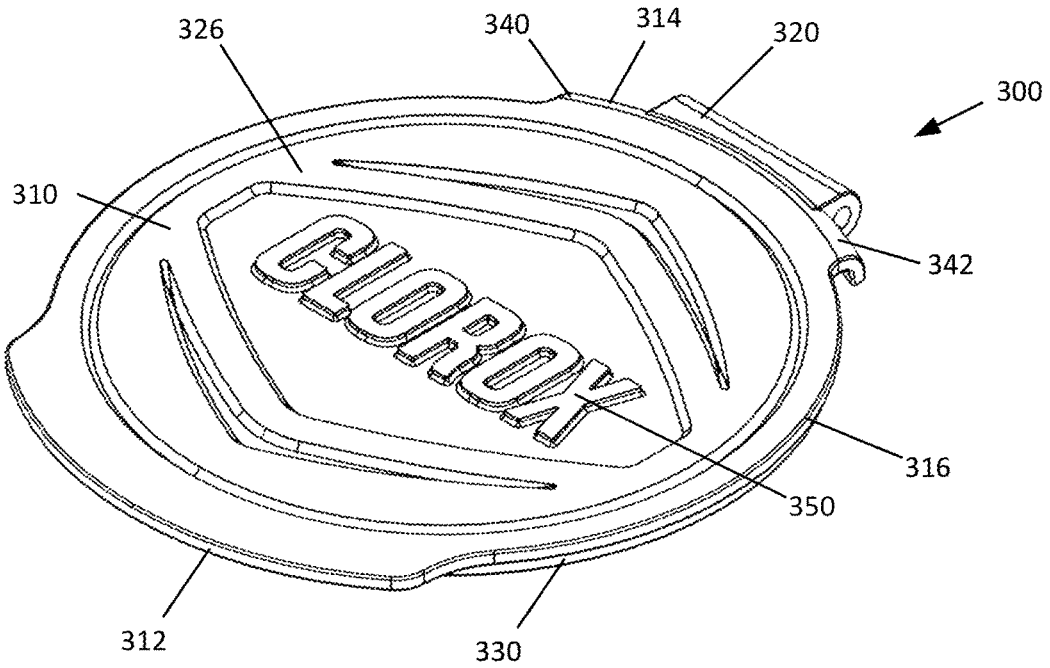
FIG. 9 is a top perspective view of the lid of the closure mechanism illustrated in FIG. 7.
Figure 10:
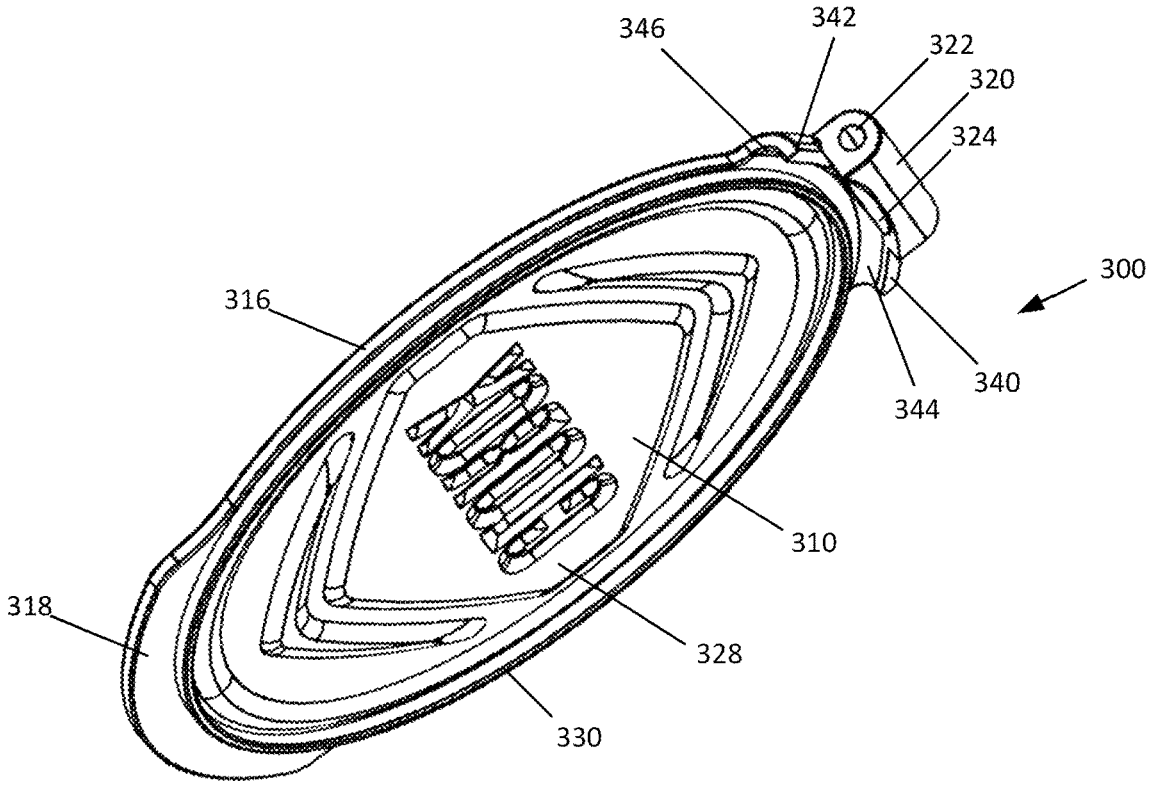
FIG. 10 is a bottom perspective view of the lid illustrated in FIG. 9.

Turning to FIGS. 7 and 8, the closure mechanism 220 is described in greater detail. As mentioned above, the closure mechanism 220 has a lid 300 that is pivotally coupled to a base 400 via a hinge 230. The lid 300 is movable between a closed position 226 (see FIG. 7), and an opened position 228 (see FIG. 8). The lid 300 has a body 310 that has an outer perimeter 316 that is proximate to the base 400 when the lid 300 is in its closed position 226. As a result, the lid 300 and the base 400 engage to seal the contents of the canister 200 inside. The body 310 of the lid 300 also includes a front lip portion 318 that can be engaged by a user to lift the lid 300 upward to disengage it from the base 400.

Referring to FIG. 8, the lid 300 has been pivoted about hinge 230 to its opened position 228. The base 400 has a body 410 with a generally circular configuration and has an inner wall 416 that defines an opening 435 through the body 410. In this embodiment, the body 410 includes a pair of landing members 490 and 492 which define therebetween a gripping channel 494 through which wipes may travel to be dispensed from the canister.

Turning to FIGS. 9-14, various views of the lid 300 are illustrated. Initially referring to FIGS. 9 and 10, lid 300 includes a body 310 that has an upper surface 326 and a lower surface 328 opposite to the upper surface 326. The body 310 includes indicia 350 formed in the upper surface 326 by way of patterned recesses, thereby forming a textured surface. The indicia 350 is also visible through patterned projections, which correspond to the patterned recesses. In this embodiment, the indicia 350 is the brand name "CLOROX."

The body 310 has a front end 312 and an opposite back end 314. An outer perimeter 316 extends on both sides of the body 310 between the front end 312 and the back end 314. The front lip portion 318 mentioned above is illustrated in FIG. 10. Extending downwardly from the lower surface 328 in a continuous loop shape is a downwardly oriented wall 330. This wall 330 engages a corresponding groove formed in the base 400 of the closure mechanism 220 to effectuate the sealing between the lid 300 and the base 400.

At the back end 314 of the lid 300 is a hinge portion 320 that defines a passageway 322 through which a coupler can be inserted to pivotally couple the lid 300 to the base 400. To further accomplish the sealing function, the lid 300 includes curved wall portions 340 and 342, which have inner curved surfaces 344 and 346, respectively. The hinge portion 320 also includes a curved surface 324 that collectively forms a continuous curved surface with surfaces 344 and 346. The curved surfaces 344 and 346 are configured to match the curvature of the base 400.

Figure 11:
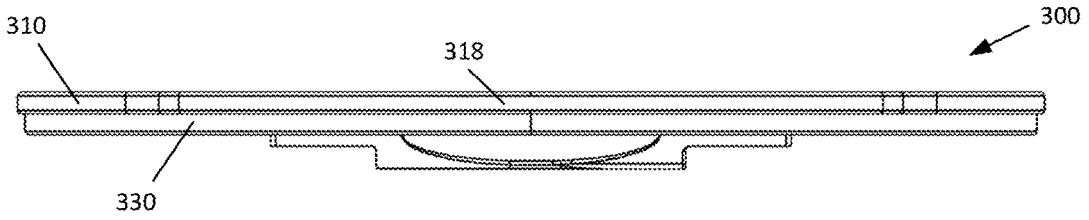
FIG. 11 is a front view of the lid illustrated in FIG. 9.
Figure 12:
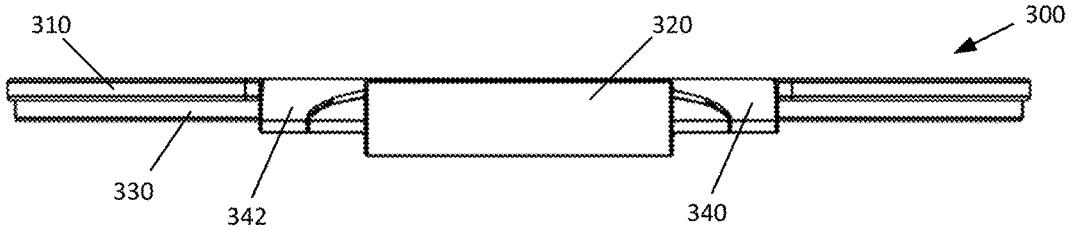
FIG. 12 is a rear view of the lid illustrated in FIG. 9.
Figure 13:
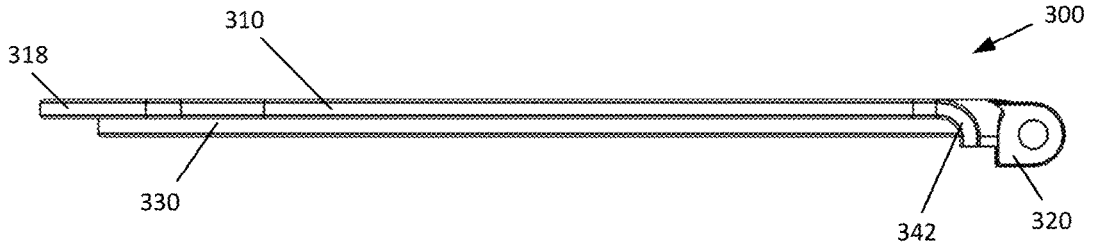
FIG. 13 is a side view of the lid illustrated in FIG. 9.
Figure 14:
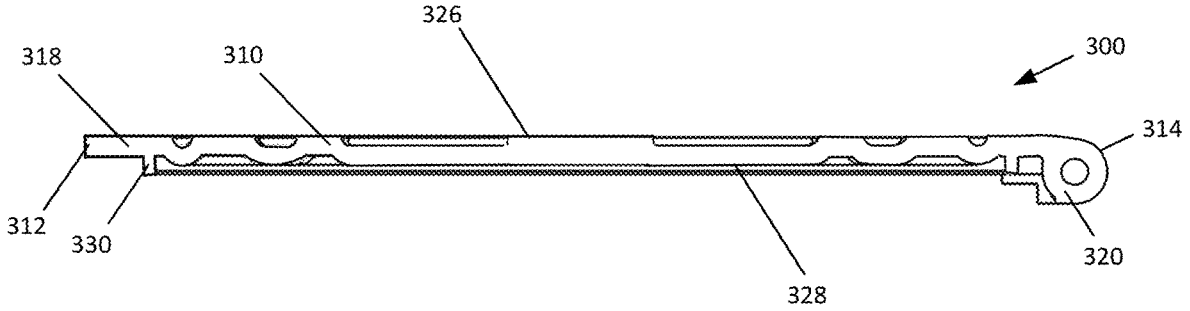
FIG. 14 is a cross-sectional side view of the lid illustrated in FIG. 9.

Referring to FIGS. 11-14, various views of the lid 300 are illustrated, including a front end view in FIG. 11, a back end view in FIG. 12, a side view in FIG. 13, and a cross-sectional side view in FIG. 14. The various components of the lid 300 as described above are shown. In FIG. 11, the body 310 with its front lip portion 318 and its downwardly extending wall 330 is illustrated. In FIG. 12, the hinge portion 320 and the curved wall portions 340 and 342 are shown in addition to the body 310 and wall 330. In FIG. 13, the body 310 with front lip portion 318, wall 330, hinge portion 320 and curved wall portion 342 are illustrated. In FIG. 14, the front end 312 and back end 314 and the upper surface 326 and lower surface 328 of the body 310 are illustrated. The front lip portion 318 and the hinge portion 320 being located at opposite ends are also shown.

Figure 15:
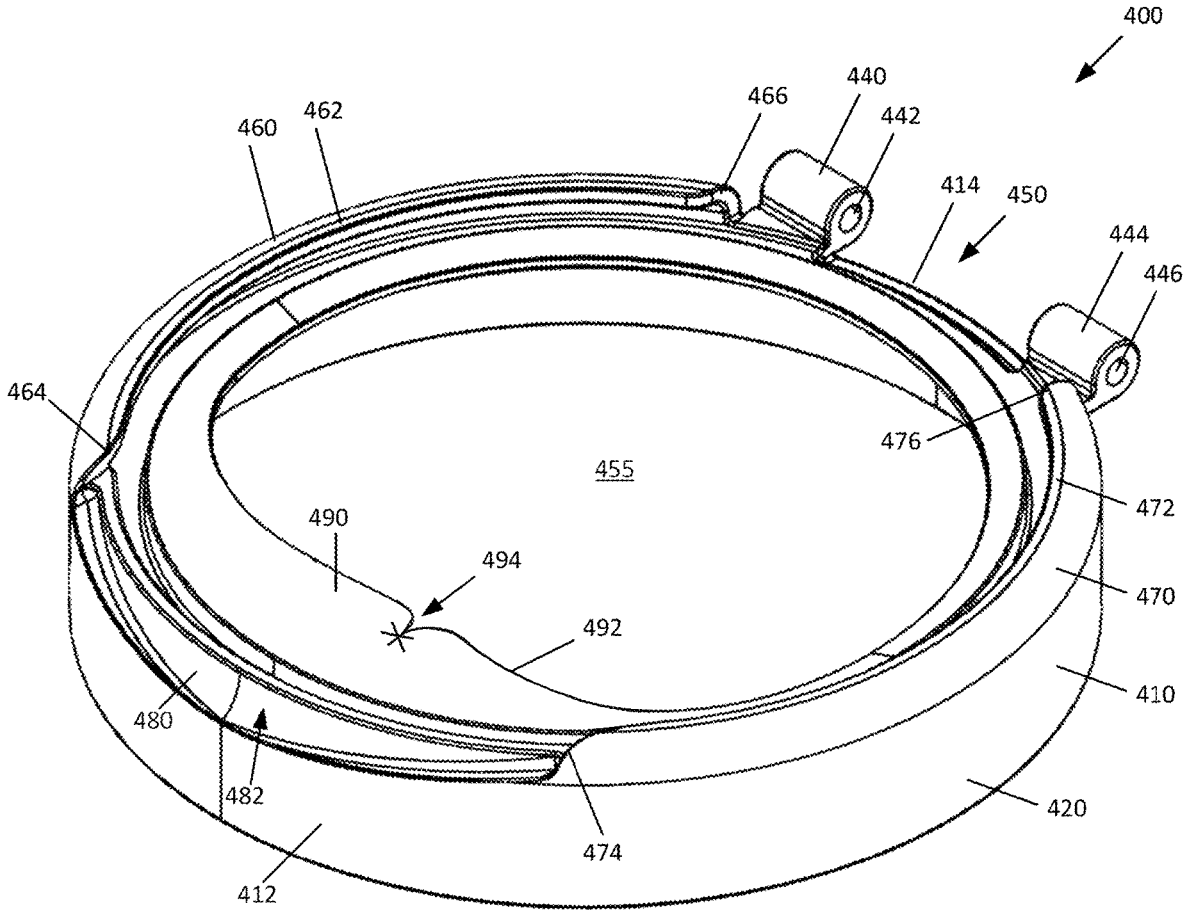
FIG. 15 is a top perspective view of the base of the closure mechanism illustrated in FIG. 7.

Turning to FIGS. 15-18, different views of the base 400 of the closure mechanism 220 are illustrated. Referring to FIG. 15, the base 400 includes a body 410 that has general cylindrical shape. The body 410 has a front end 412 and a back end 414. Located at the back end 414 are hinge members 440 and 444 which are spaced apart by a gap 450 so that hinge portion 320 on lid 300 can be placed therebetween. Hinge members 440 and 444 have passageways 442 and 446 formed therein, respectively, through which a coupler (not shown) can be inserted and also engaged with passageway 322 in lid 300 to pivotally couple the lid 300 to the base 400.

Body 410 includes a ring or sleeve 420 that defines a central opening 455. The front of body 410 includes a curved surface 480 that forms a groove 482 into which a user can insert a finger beneath the front lip portion 318 of the lid 300. Sleeve 420 has upwardly oriented curved walls on opposite sides. In particular, curved wall 460 extends upwardly from one side of sleeve 420, and curved wall 470 extends upwardly from the opposite side of sleeve 420. Curved wall 460 has an inner edge 462 that is proximate to the perimeter 316 of the lid 300 when the lid 300 is in its closed position 226. Curved wall 460 also has opposite ends 464 and 466. When the lid 300 is closed, end 466 is proximate to curved wall portion 340 of lid 300. Similarly, curved wall 470 has an inner edge 472 that is proximate to the perimeter 316 of the lid 300 when the lid 300 is in its closed position 226. Curved wall 470 also has opposite ends 474 and 476. When the lid 300 is closed, end 476 is proximate to curved wall portion 342 of lid 300. Landing members 490 and 492 define a gripping channel 494 therebetween.

Figure 16:
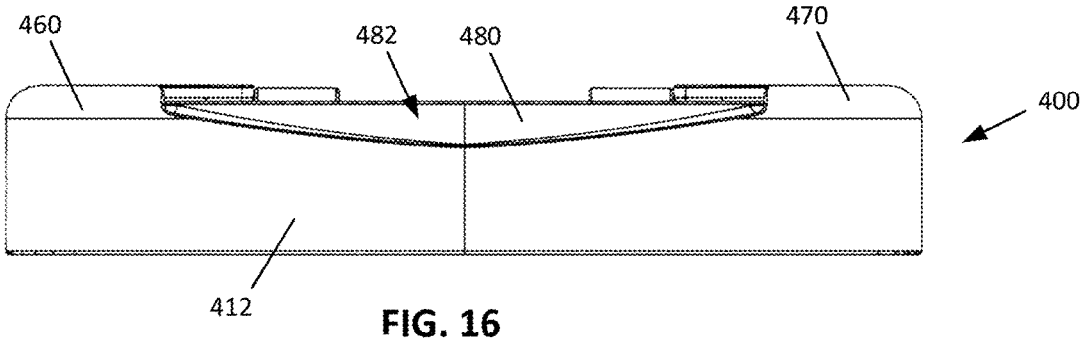
FIG. 16 is a front view of the base illustrated in FIG. 15.
Figure 17:
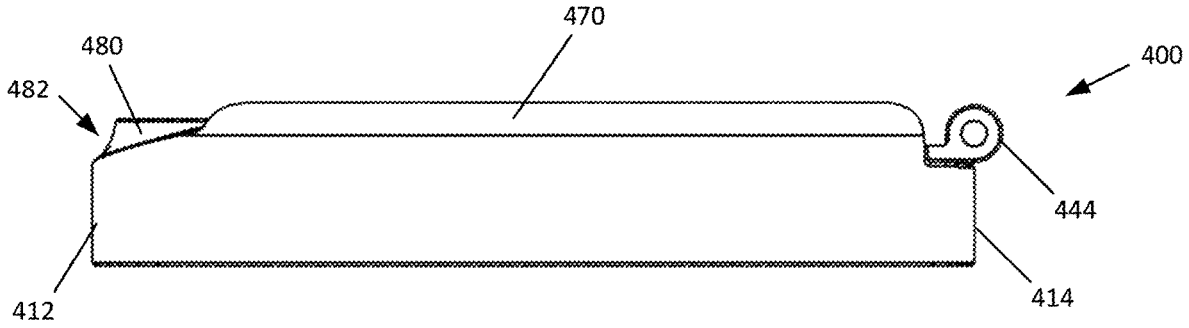
FIG. 17 is a side view of the base illustrated in FIG. 15.
Figure 18:
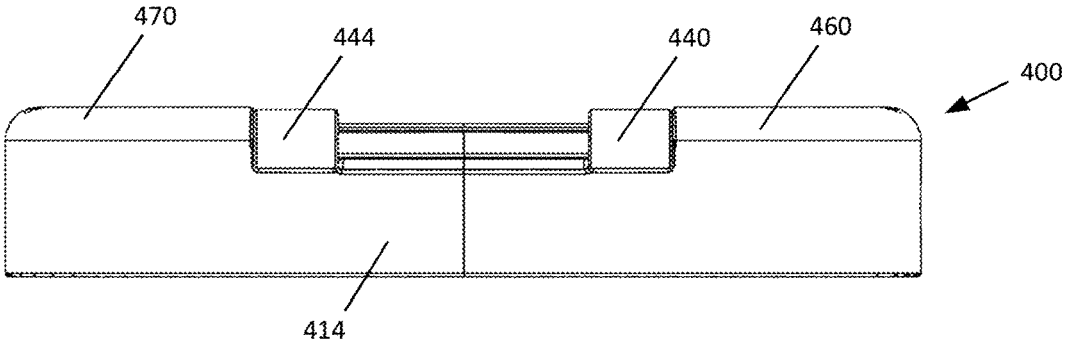
FIG. 18 is a rear view of the base illustrated in FIG. 15.

Referring to FIGS. 16-18, various components of the base 400 are illustrated. In FIGS. 16 and 17, the curved surface 480 and the groove 482 that the curved surface 480 forms are shown proximate to the front end 412. In FIGS. 17 and 18, the hinge members 440 and 444 are shown proximate to the back end 414. The opposing upper curved walls 460 and 470 are shown as well.

In a conventional straight walled canister, the outer surface of the canister body has a constant diameter from the upper end to the lower end of the canister body. In canisters according to the present disclosure, the outer surface of the canister body has a varying outer diameter and sometimes also has a varying configuration.

Figure 19:
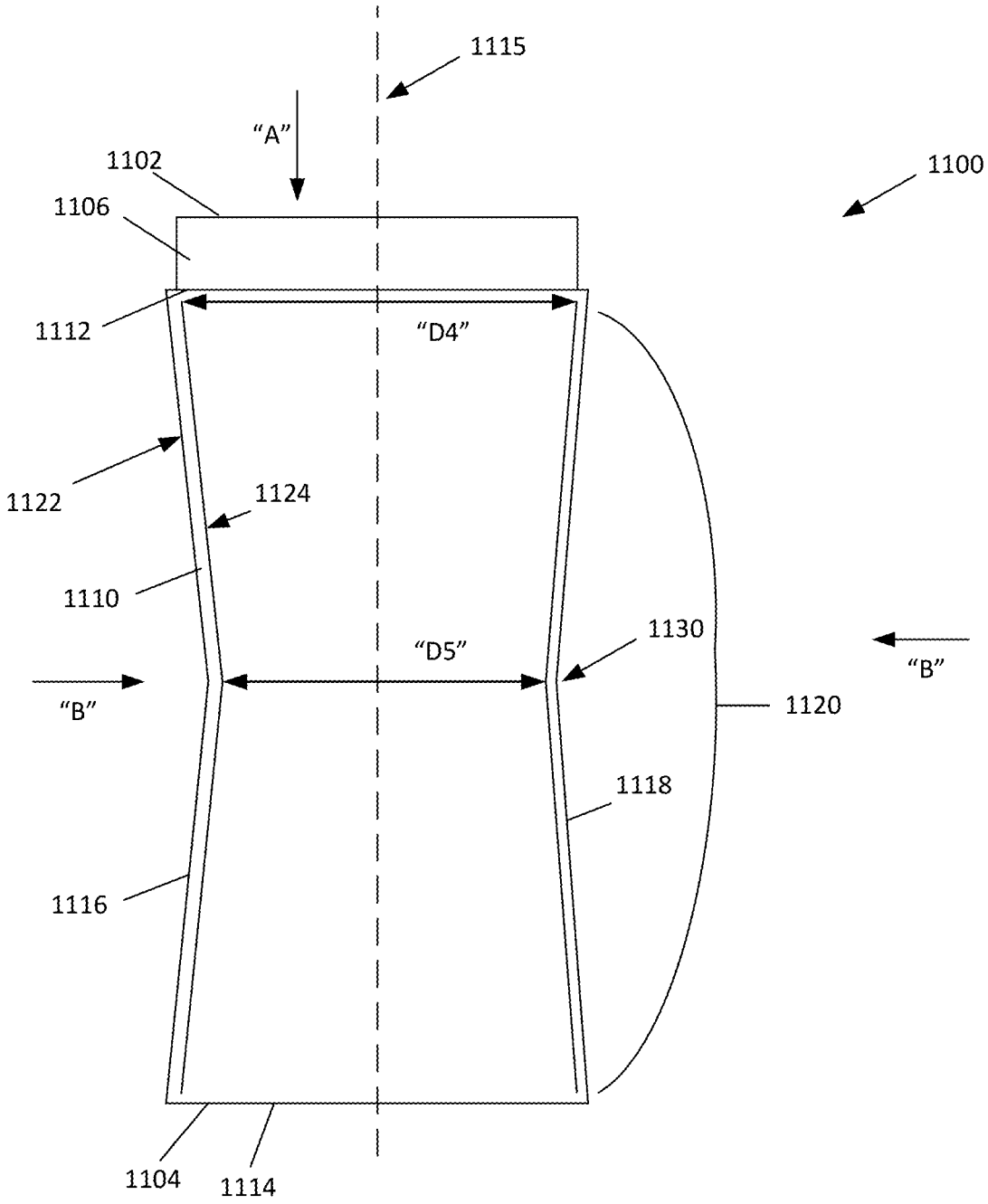
FIG. 19 is a schematic diagram of a side view of an exemplary embodiment of a dispensing container according to the present disclosure.

Referring to FIG. 19, a schematic diagram of an embodiment of a dispensing container according to the present disclosure is illustrated. The dispensing container 1100, which can be referred to alternatively as a dispensing canister, has a first end 1102 and a second end 1104 opposite to the first end 1102. Container 1100 includes a body 1110 that has a first end 1112 and a second end 1114 opposite to first end 1112. In the orientation shown in FIG. 19, the first ends 1102 and 1112 can be referred to as upper ends, and the second ends 1104 and 1114 can be referred to as lower ends. The body 1110 also has a longitudinal axis 1115 that extends from the first end 1112 to the second end 1114.

The body 1110 has a neck section or neck portion 1106 at its upper end 1112. In one embodiment, the neck section 1106 is integrally formed with the body 1110. In another embodiment, the neck section 1106 is formed separately from the body 1110 and subsequently coupled thereto. The neck section 1106 may have one or more grooves or one or more threads formed on its outer surface to which a closure mechanism (not shown in FIG. 19) may be removably coupled.

The body 1110 has an outer surface that extends around the perimeter of the body 1110. The body 1110 has a continuous wall around its perimeter, and in FIG. 19, that continuous wall is shown as opposing side walls 1116 and 1118. The outer surface 1122 defines the outer diameter of the body 1110 along the length of the body 1110. Body 1110 has an intermediate portion or section 1120 that is located between the first end 1112 and the second end 1114. The intermediate portion 1120 has a varying outer diameter along its length. In particular, the outer diameter of the intermediate portion 1120 is at its largest proximate to the first end 1112 and also proximate to the second end 1114. The body 1110 has a smallest diameter section 1130 that is located within the intermediate portion 1120. The smallest diameter section 1130 can be referred to alternatively as the narrowest point of the body 1110, and the body 1110 can be described as having a shaped or waisted configuration or an hourglass configuration. The outer diameter decreases along the length of the body 1110 from the first end 1112 to the smallest diameter section 1130. The outer surface is tapered or angled inwardly from the first end 1112 to the smallest diameter section 1130. Similarly, the outer diameter decreases along the length of the body 1110 from the second end 1114 to the smallest diameter section 1130. The outer surface is tapered or angled inwardly from the second end 1114 to the smallest diameter section 1130.

The body 1110 also has an inner surface 1124 that defines an inner diameter that varies as well. The inner diameter "D4" proximate to the upper end 1112 and to the lower end 1114 is larger than the inner diameter "D5" at the smallest diameter section 1130. The body 1110 has a generally constant thickness along the length of the body 1110.

While the smallest diameter section 1130 is illustrated in FIG. 19 at the middle or center location of the body 1110, in different embodiments, the location of the smallest diameter section 1130 can be located at any position along the body 1110 and within the intermediate portion 1120.

The waisted configuration of the body 1110 provides an improved performance of the canister 1100, and in particular the body 1110, when a force is applied to them. With the orientation shown in FIG. 19 being an upright configuration or orientation, a typical direction in which a force is applied to the canister 1100 is along the direction of arrow "A". Such a force is applied to the top of the canister 1100 along the direction of longitudinal axis 1115, which occurs when canisters 1100 are stacked on each other. Often during shipping or transporting the canisters 1100, packages of canisters are stacked upon each other, such as when being loaded on a pallet. Ideally, the canister 1100 can withstand a force applied along the direction of arrow "A" with minimal damage imparted to the canister 1100.

When a force is initially applied to a canister along the direction of arrow "A", the material in the heel of the canister is pushed inwardly initially. For a conventional straight wall canister, when the applied force increases, the wall of the canister body buckles and experiences severe denting. Buckling and denting of the canister body causes permanent deformation and potentially results in cracking of the body, which results in leaks of liquid from the cavity of the body.

The ability of a canister body to support an applied force or weight is determined by the canister body's ability to provide resistance to that force or weight. For a canister according to the present disclosure, as a force applied to the canister continues to increase, the waisted or shaped configuration of the canister body improves the ability of the canister body to support and withstand the applied force with minimal damage to the body. Such a canister body does not buckle and also supports or resists more force sooner than conventional canisters, which means that a larger force can be supported and absorbed by a canister body according to the present disclosure before more damage is encountered by the canister wall.

Figure 28:
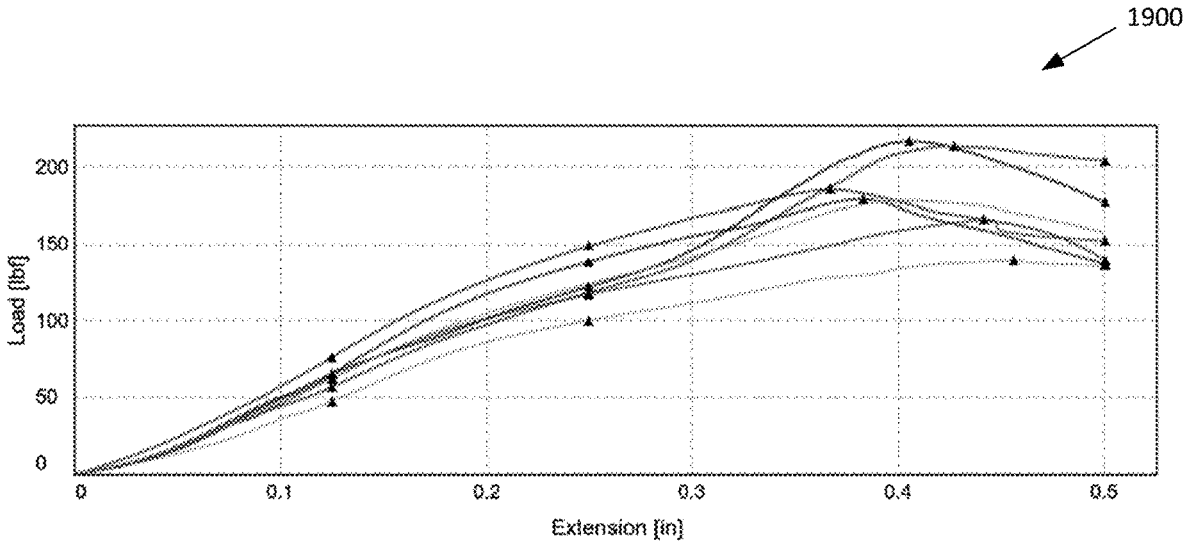
FIG. 28 is a graph of test results of several different embodiments of waisted or shaped canisters according to the present disclosure showing the relationship between applied load forces and the resulting displacement or shortening of the canisters.

A canister body having a narrowed or reduced diameter portion enhances that canister body's ability to support and withstand a larger applied force. In particular, as an applied force increases, the portion of the canister body above the waist portion will roll over the waist portion, which reduces any buckling of the canister body. The result is that the canister body with a waist portion can support an increasing load with a gradual compression of the length of the body up to a maximum load, and once the maximum load that the canister body can support is reached, then there is a gradual decreasing of the supported load as the canister body continues to be compressed. This concept is illustrated in FIG. 28 and is described in greater detail below.

Another force that can be applied to the canister 1100 is shown by the directions of arrows "B". A force can be applied to one or more sides of the canister 1100 during transportation or the handling of the canister 1100. When a force is applied along the direction of arrow "B", denting of the body 1110 is less of a concern than the closure mechanism decoupling from the body 1110. Ideally, the canister 1100 can withstand a force along the direction of arrow "B" so the seal of the canister maintains its integrity. To maintain the seal, the closure mechanism at the upper end of the canister 1100 needs to remain coupled to the canister body 1110. Testing relating to forces applied to the body 1110 is discussed in greater detail below relative to Table 9.

Figure 20:
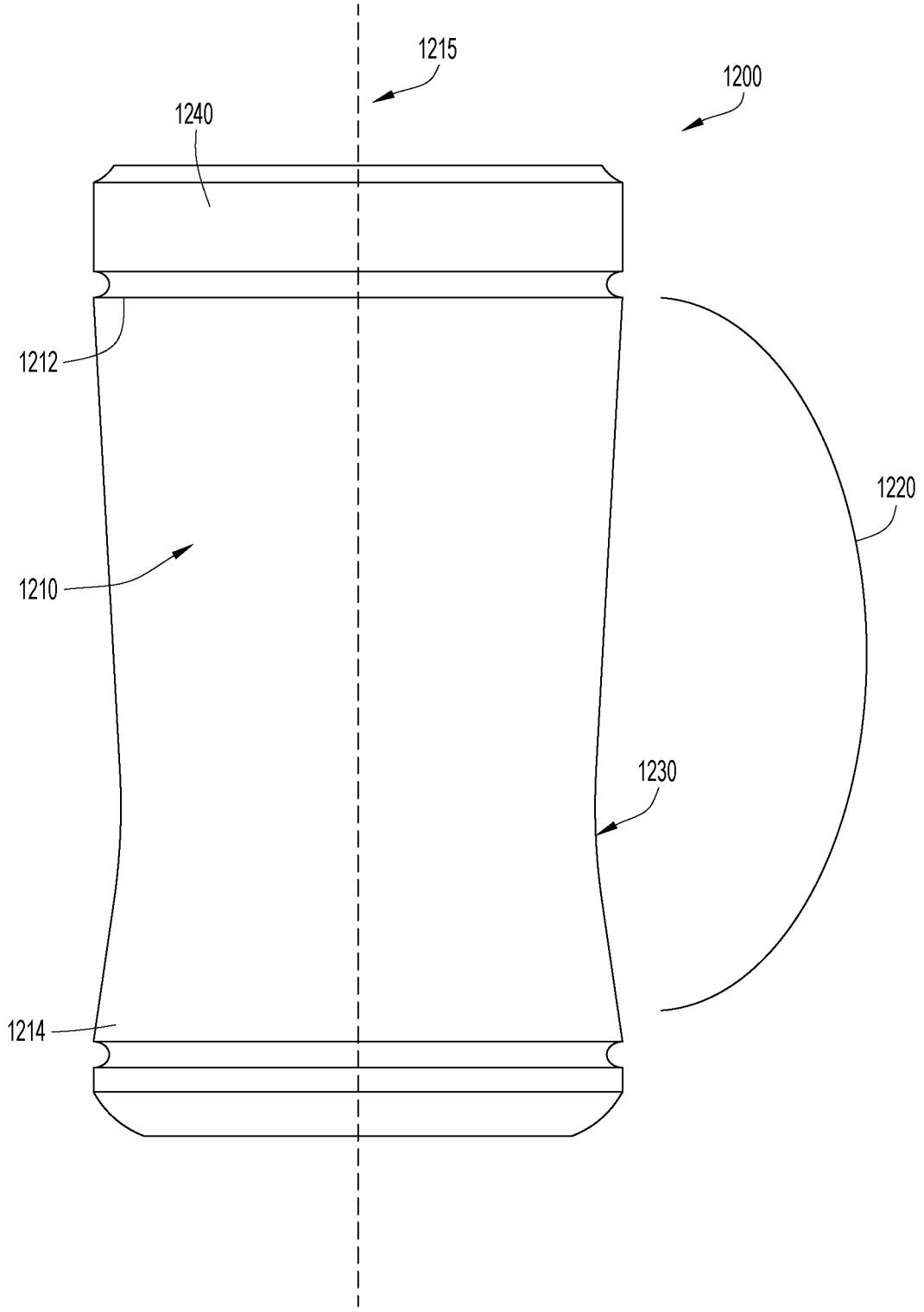
FIG. 20 is a side view of another embodiment of a dispensing container according to the present disclosure.

Referring to FIG. 20, a side view of another embodiment of a dispensing container according to the present invention is illustrated. Dispensing container 1200 has a body 1210 to which a closure mechanism 1240 is removably coupled via one or more grooves or threads. The body 1210 has a first end or upper end 1212 and a second end or lower end 1214 opposite to the first end or upper end 1212. A longitudinal axis 1215 extends from the upper end 1212 to the lower end 1214 of the body 1210.

The outer surface of the body 1210 defines an outer diameter that varies along the length of the body 1210. An intermediate portion 1220 of the body 1210 is located between the upper end 1212 and the lower end 1214. The body 1210 has a smallest diameter section or narrowest portion 1230 that is located in the intermediate portion 1220. In this embodiment, the narrowest portion 1230 is located closer to the second end 1214 than to the first end 1212, and thus, is located in the bottom half of the body 1210.

Figure 21:
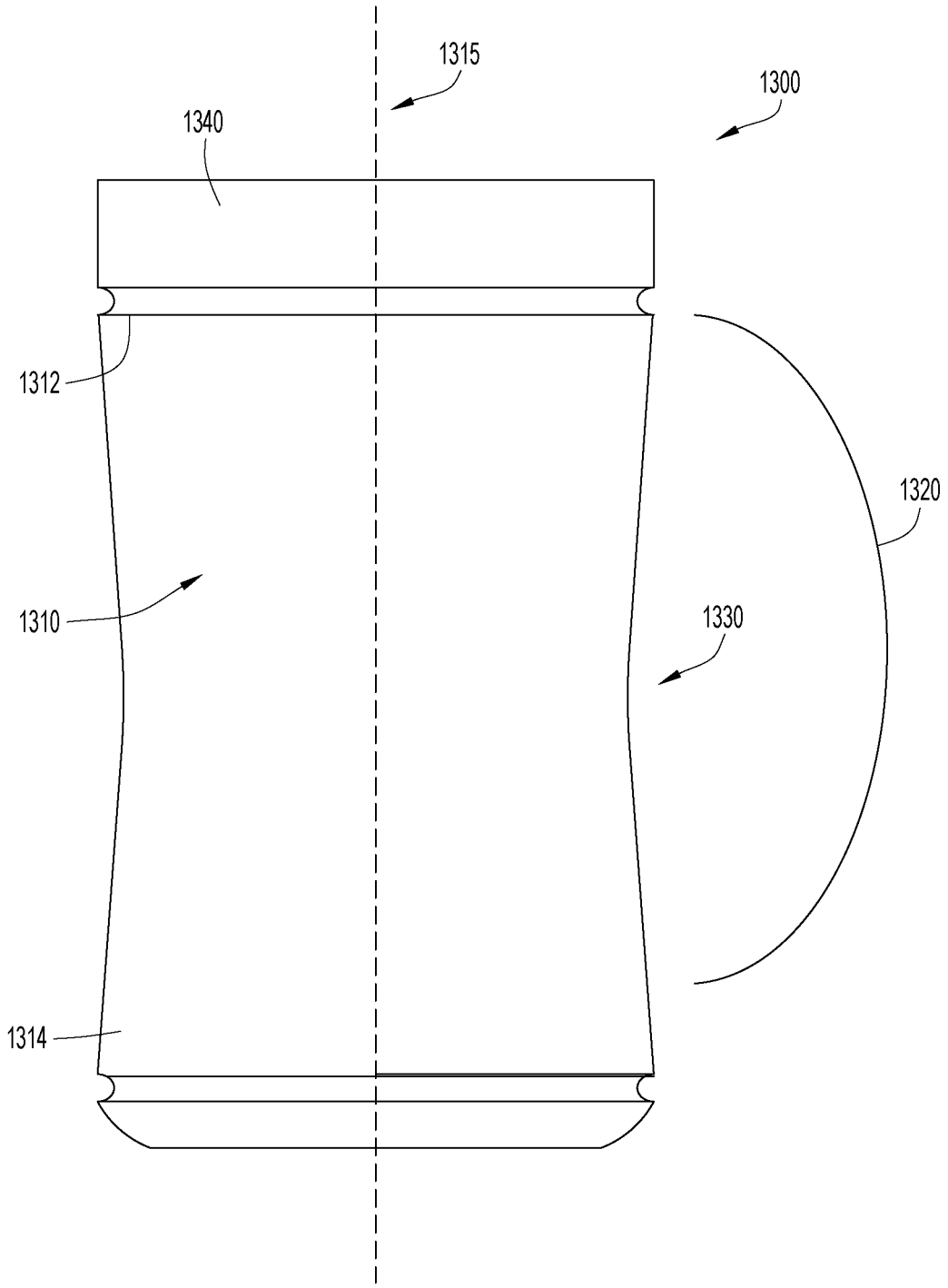
FIG. 21 is a side view of another embodiment of a dispensing container according to the present disclosure.

Referring to FIG. 21, a side view of another embodiment of a dispensing container is illustrated. Dispensing container 1300 has a body 1310 to which a closure mechanism 1340 is removably coupled. The body 1310 has an upper end 1312 and a lower end 1314 opposite to the upper end 1312. A longitudinal axis 1315 extends from the upper end 1312 to the lower end 1314. The outer surface of the body 1310 defines an outer diameter that varies along the length of the body 1310. For body 1310, a narrowest portion 1330 is located within an intermediate portion 1320, and is located at the midpoint of the body 1310.

Figure 22:
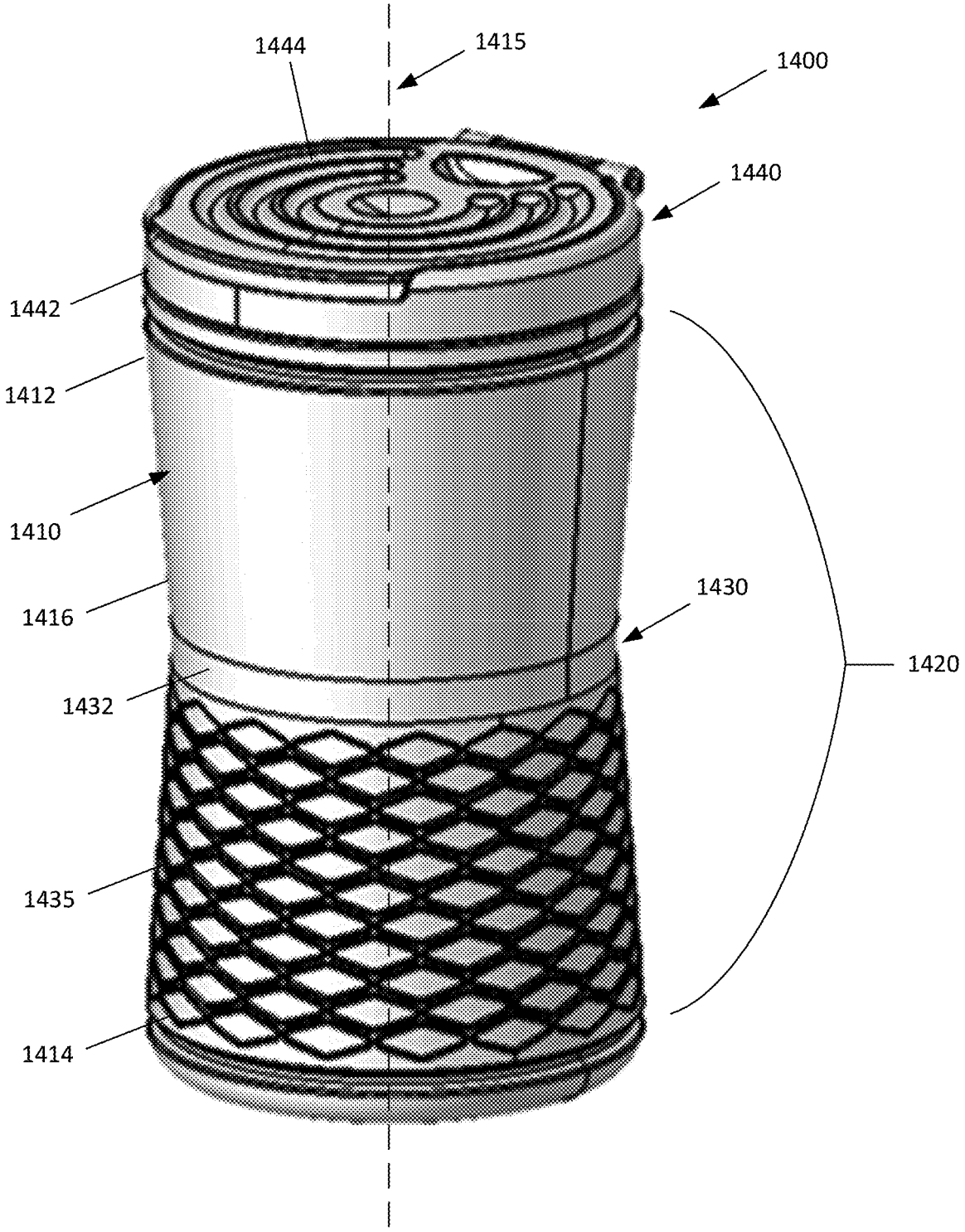
FIG. 22 is a top perspective view of another embodiment of a dispensing container according to the present disclosure.

Referring to FIG. 22, a top perspective view of another embodiment of a dispensing container according to the present invention is illustrated. Dispensing container 1400 has a body 1410 to which a closure mechanism 1440 is removably coupled. The closure mechanism 1440 includes a base 1442 and a pivotally mounted lid or cover 1444. The body 1410 has an upper end 1412 and an opposite lower end 1414 and a longitudinal axis 1415 extends from the upper end 1412 to the lower end 1414.

The side 1416 of the body 1410 defines the outer surface that has a varying outer diameter. An intermediate portion 1420 is located between the upper end 1412 and the lower end 1414. The body 1410 has a smallest diameter section or narrowest portion 1430 that is located in the intermediate portion 1420, and in this embodiment, the narrowest portion 1430 is approximately in the middle of the body 1410. The narrowest portion 1430 is defined by a ring or band 1432 that itself may have a constant outer diameter. In various embodiments, the texture or surface pattern of the side 1416 may vary for a particular body 1410. As shown, the outer surface above the band 1432 has a smooth configuration, and the outer surface below the band 1432 has a textured pattern 1435. In this embodiment, the textured pattern 1435 has several diamond-shaped projections proximate to each other. The diamond-shaped projections are formed or defined by grooves formed in the outer surface.

Figure 23:
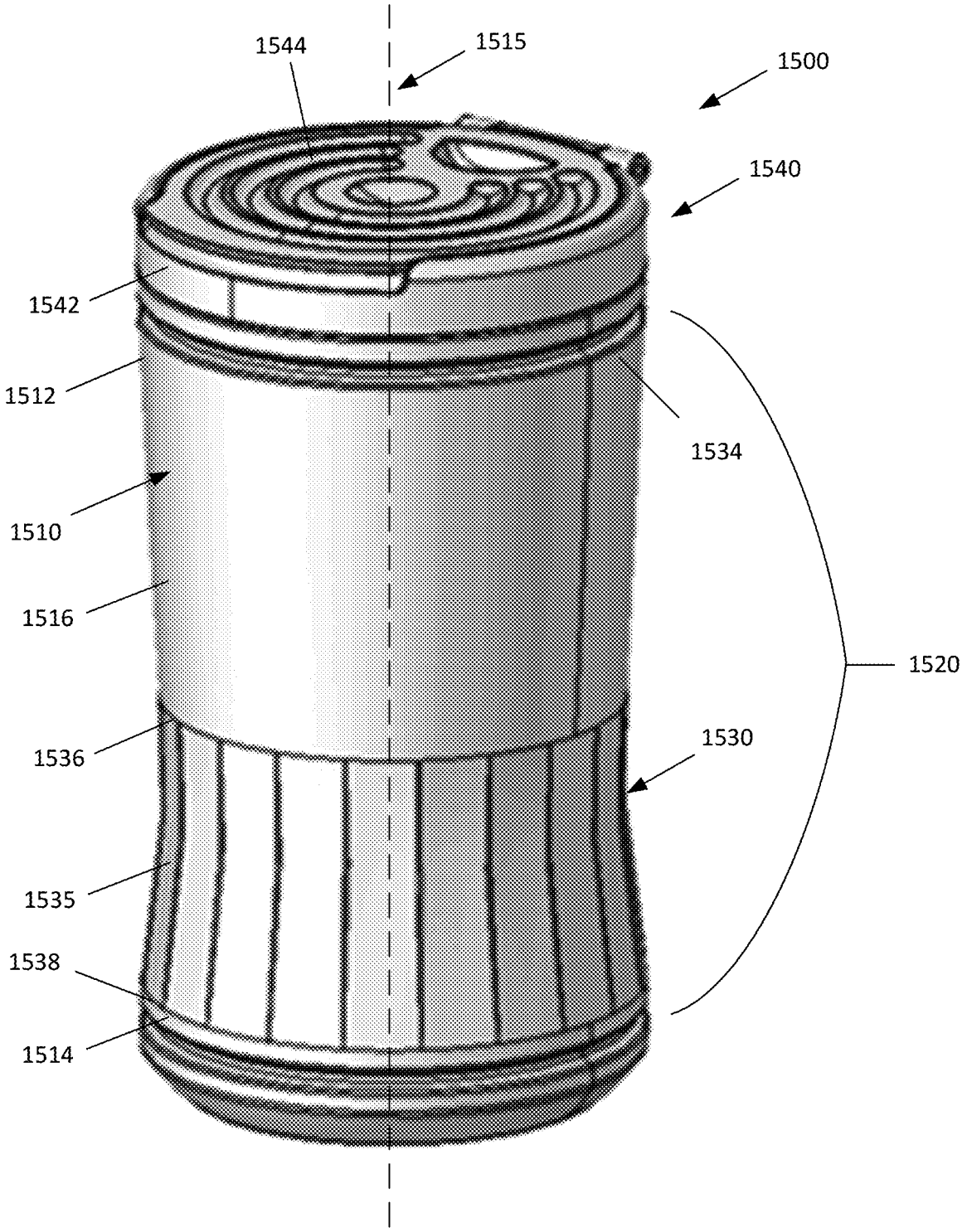
FIG. 23 is a top perspective view of another embodiment of a dispensing container according to the present disclosure.

Referring to FIG. 23, a top perspective view of another embodiment of a dispensing container according to the present invention is illustrated. Dispensing container 1500 has a body 1510 to which a closure mechanism 1540 is removably coupled. The closure mechanism 1540 includes a base 1542 and a pivotally mounted lid or cover 1544. The body 1510 has an upper end 1512 and a lower end 1514 and a longitudinal axis 1515.

The side 1516 of the body 1510 defines the outer surface that has a varying outer diameter and different surfaces. An intermediate portion 1520 is located between the upper end 1512 and the lower end 1514. The body 1510 has a smallest diameter section or narrowest portion 1530 that is located in the intermediate portion 1520. In this embodiment, the narrowest portion 1530 is located below the middle of the body 1510. As shown, the outer surface between an upper location 1534 and an intermediate location 1536 has a generally smooth configuration, and the outer surface between the intermediate location 1536 and a lower location 1538 has a pattern of vertically oriented panels 1535. The narrowest portion 1530 is located between intermediate location 1536 and lower location 1538. The dispensing containers shown in FIGS. 20-23 show that the location of the narrowed portion can be anywhere along the length of the canister body and that the tapered surfaces on either side of the narrowed portion can be angled toward the narrowed portion as well.

Figure 24:
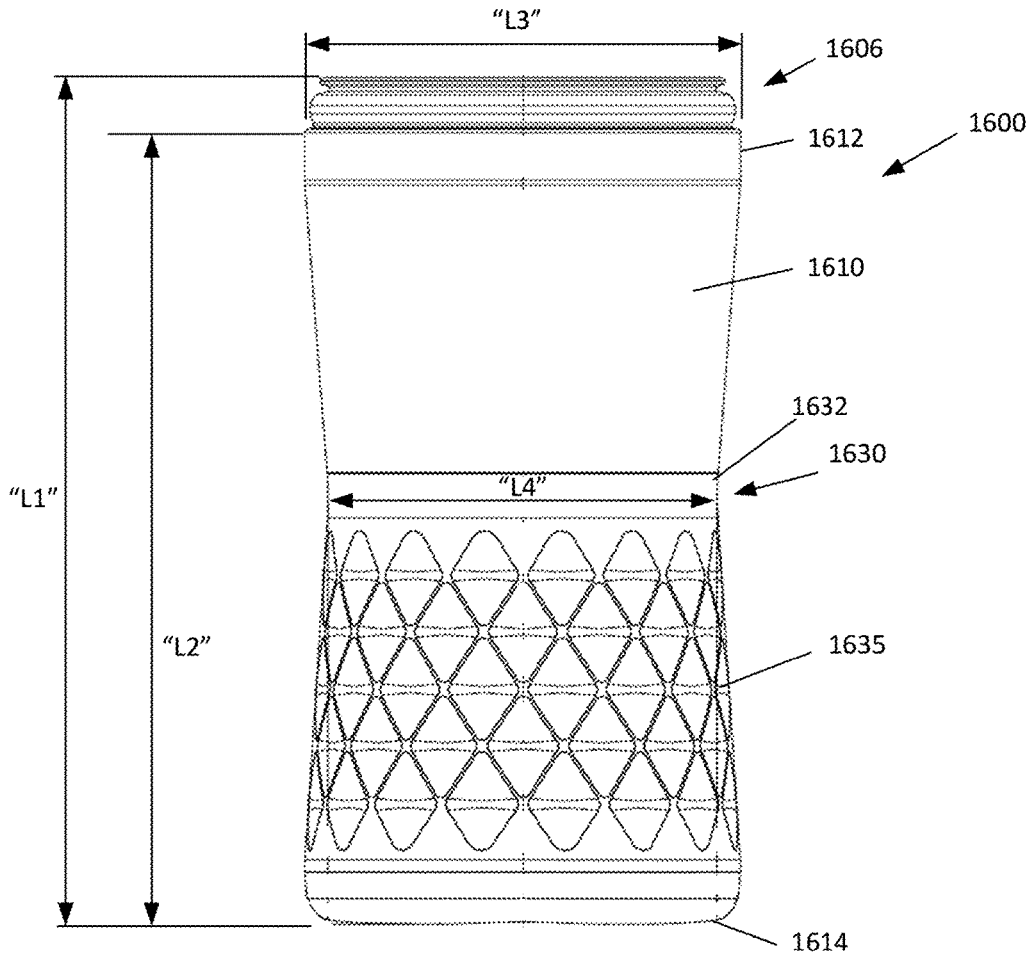
FIG. 24 is a side view of another embodiment of a dispensing container according to the present disclosure.
Figure 25:
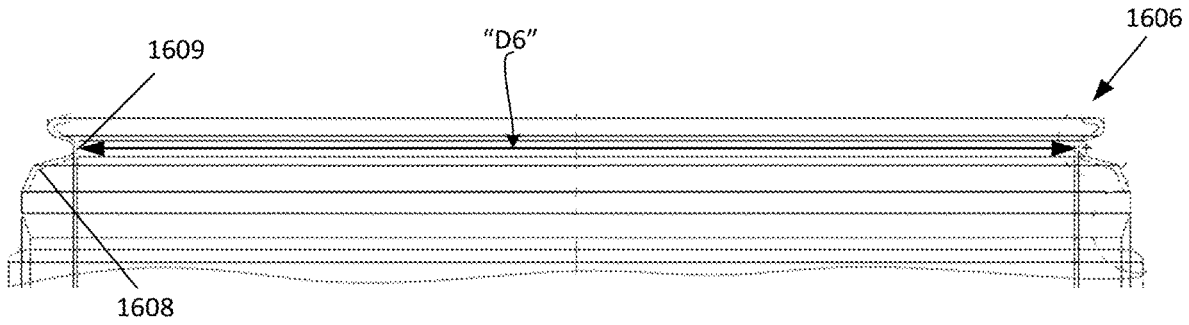
FIG. 25 is a close-up cross-sectional side view of the neck section of the dispensing container illustrated in FIG. 24.

Turning to FIGS. 24 and 25, different views of another embodiment of a dispensing container are illustrated. Referring initially to FIG. 24, dispensing container 1600 has several features that are similar to dispensing containers previously described above, and thus, not all of those similar features are described in detail relative to dispensing container 1600. Dispensing container 1600 has a body 1610 with a narrowed portion 1630, which is located at band 1632. A textured surface pattern 1635 is provided below the band 1632 as well. Body 1610 includes a neck section or neck portion 1606 formed at its upper end.

In this embodiment, the canister body 1610 has an overall length "L1" of 8.271 inches or 210.083 mm, which includes the neck section 1606. The length "L2" of the canister body 1610 without the neck section 1606 is 7.731 inches or 196.367 mm. The outer surfaces of the canister body 1610 proximate to both the first end 1612 and the second end 1614 of the body 1610 have outer width or diameter "L3" of 4.25 inches or 107.95 mm. Canister body 1610 has a shaped configuration or a waisted configuration in which the outer surface of the body 1610 in the intermediate portion has a smaller outer diameter than at the ends 1612 and 1614. The outer diameter of the narrowest portion of the body 1610 is "L4" which is 3.798 inches or 96.469 mm.

As discussed throughout this description, a canister body according to the present disclosure has a varying outer diameter, which creates a waisted or shaped configuration. One characteristic is that a ratio of the outer diameter of the canister body proximate to one of its ends to the outer diameter of the canister body of the narrowed or smallest diameter portion. In the embodiment illustrated in FIG. 24, that ratio is "L3" over "L4", which is 107.95 mm over 96.469 mm or a ratio of 1.12.

In FIG. 25, a cross-sectional view of the neck section 1606 is illustrated. Neck section 1606 is formed to have several curved portions that retain a closure mechanism (not shown) thereon. Neck section 1606 includes an inner surface 1608 that has a curved configuration and an innermost point 1609. The innermost point 1609 of the neck section 1606 defines an inner diameter "D6" across the inner width of the cavity of the body 1610. Inner diameter "D6" is the smallest inner diameter of the neck section 1606. Referring back to FIG. 19, the smallest inner diameter of body 1110 of the canister 1100 is defined by inner diameter "D5", which is the waist of the body 1110, and which is also the same concept for body 1610. Inner diameter "D5" is calculated so that it is no smaller than the smallest inner diameter "D6" of the neck section 1606. In other words, the smallest inner diameter "D5" of the waist is equal to or larger than the smallest inner diameter "D6" of the neck section 1606. If the smallest inner diameter "D5" of the waist is less than the smallest inner diameter of the neck section 1606, then a rolled product in the shape of a donut or cylinder, such as a roll of wipes, will hit the inner wall point 1609 and will create a difficulty during manufacturing when a roll of wipes is inserted into the cavity of the body 1110.

Now the various testing conducted on canisters is described. Several tests were conducted using conventional canisters and canisters from the present disclosure. The focus of most of the tests were to understand how the canisters performed when a load was applied to the top end of the canister. In addition, some tests were conducted by providing a side load to the canister bodies. The canisters according to the present disclosure that were tested have the feature of a narrowed section or waist, which includes the narrowest portion of the outer diameter of the body being located at some location in an intermediate location along the length of the canister body.

Data from the tests that were conducted are provided in the following tables in this description. Data that relates to conventional canisters is labeled "Conventional Canister", and data that relates to canisters according to the present disclosure is labeled "Shaped Canister". A few of the tables relate to dimension measurements of the different canisters as opposed to applied forces.

In some tests, the plastic material used for the body of the canister is either high-density polyethylene (HDPE) or polyethylene terephthalate (PET). In addition, the shape of the canister is different in some of the tests. For the conventional canisters, the canister body shape varies between a straight wall cylinder and a ribbed canister. For the canisters according to the present disclosure, a narrowed or waisted shape (such as an hourglass shape) is used for the canister body. The narrowed or waisted canister body is similar to those described herein and has a varying outer diameter and a narrowest or smallest diameter portion that is in an intermediate section of the canister body. In a few instances, in addition to the narrow waist feature, the shaped canister also has an outer texture formed in its outer surface.

Table 1 below relates to the measured outer diameters of the different canisters, and in particular, the smallest measured outer diameter for each of the different canisters. As shown, the conventional canisters are both 107.95 mm at their smallest outer diameter. For the shaped canisters, the measured outer diameters at their narrowest or smallest point are between 95.99 mm and 96.47 mm. Notably, the outer diameters of the shaped canisters at their upper end and at their lower end are the same as the conventional canisters' outer diameter of 107.95 mm.

TABLE 1

| | Conventional Canister | Conventional Canister | Shaped Canister | Shaped Canister |
|---|---|---|---|---|
| Material | HDPE | PET | HDPE | PET |
| Shape | Straight Wall | Ribbed | Narrow Waist and Outer Texture | Narrow Waist |

TABLE 1-continued

| | Conventional Canister | Conventional Canister | Shaped Canister | Shaped Canister |
|---|---|---|---|---|
| Diameter at Smallest Point | 107.95 mm | 107.95 mm | 96.47 mm | 95.99 mm |

As mentioned above, a force applied to the top of a canister may cause the body of the canister to deform. If the applied force continues to increase, then the canister body will start to deform. One way in which a canister body deforms in response to an applied force is that it may start to be compressed along its length. In other words, the overall length of the canister body along its longitudinal axis is shortened. During a test that was conducted, a force applied to a canister body starts at 0 lbf and is continuously increased. As the applied force increases, the canister length shortens. Each canister has a particular point at which it can withstand the most applied load. That particular point is referred to a maximum top load location, which corresponds to a compressed distance of the length of the canister body at which the most weight can be withstood. After that maximum top load location, the amount of load that the canister body can withstand and support decreases, which is due to the canister body losing its structural integrity. As the canister body is unable to continue withstanding the increased applied force, the damage to the canister body increases. Such increased damage may result in the canister body folding, bending, creasing, buckling, and potentially also cracking. If the maximum top load is reached after the canister body has compressed a large amount, the canister body will experience a large amount of damage due to the large amount of compression and the canister body will buckle. This situation occurs in conventional canisters when the maximum top load is not reached until the canister body is compressed a large amount. During testing, conventional canisters buckled which resulted in a drop in the applied force that the canister body could support.

There is a balance to be struck so that the maximum top load that a canister can withstand occurs early enough to avoid substantial compression and damage to the canister body. Another goal is to create a canister body shape that avoids a severe drop in the strength of the canister body as the applied force increases. A severe drop in strength is due to the buckling of the canister body. Once the canister body has buckled, it resettles. Ideally, for the canister bodies according to the present disclosure, the canister body can resist a larger force sooner before damage occurs to the canister wall. This earlier resistance of a greater force is due to the canister body shape permitting some deformation (shortening) of the body prior to the maximum top load is reached, and then a gradual decrease in the deformation of the body after the maximum top load is passed.

Table 2 below relates to two conventional canisters and one shaped canister. Each of the three tested canisters had a weight of 60 grams, which is dictated by the quantity of plastic material used to make the canister body. The "Maximum Top Load" is the measurement of the maximum force (in lbf) applied to the top of a canister that the canister can support. The "Maximum Top Load Location" is the distance that the canister body has been compressed or has shrunk from its initial configuration/length when the maximum top load that the canister body can support has been identified. Thus, a larger number for the "Maximum Top Load Location" means that the canister body has been compressed more from its original unbiased length. The greater the compression results in the greater the likelihood of damage to the canister body.

Turning to Table 2, the maximum top loads that the conventional canister can support are less than the maximum top load that the shaped canister can support. In the testing, while the conventional canisters could support 133.29 lbf and 120.19 lbf, the shaped canister could support a larger applied force. As shown, the shaped canister could support 182.19 lbf due to the waist shape of the canister body, which permits the upper portion of the canister body to roll over onto the narrow waist portion to support that higher force. The result of supporting a larger force is that if a force of 140 lbf is applied to the tested canisters in Table 2, the conventional canisters would have exceeded their maximum top load and may likely have buckled while the shaped canister has not yet reached its maximum top load and therefore has suffered less damage than the conventional canisters.

As shown in Table 2, the maximum top load (133.29 lbf) that the straight wall conventional canister was able to support occurred when the canister body was compressed 0.47 inches. The ribbed conventional canister supported its maximum top load (120.19 lbf) when the canister body was compressed 0.204 inches. For the shaped canister with a narrow waist, its maximum top load (182.19 lbf) occurred when the canister body was compressed 0.375 inches. Thus, the shaped canister supported a much larger applied force than the conventional canisters. In addition, relative to the straight wall conventional canister, the shaped canister supported its larger maximum top load with approximately 0.1 inches less compression of its canister body.

TABLE 2

| | Conventional Canister | Conventional Canister | Shaped Canister |
|---|---|---|---|
| Material | HDPE | PET | HDPE |
| Shape | Straight Wall | Ribbed | Narrow Waist and Outer Texture |
| Maximum Top Load (60 g) | 133.29 lbf | 120.19 lbf | 182.19 lbf |
| Maximum Top Load Location | 0.47 in | 0.204 in | 0.375 in |

Figure 26:
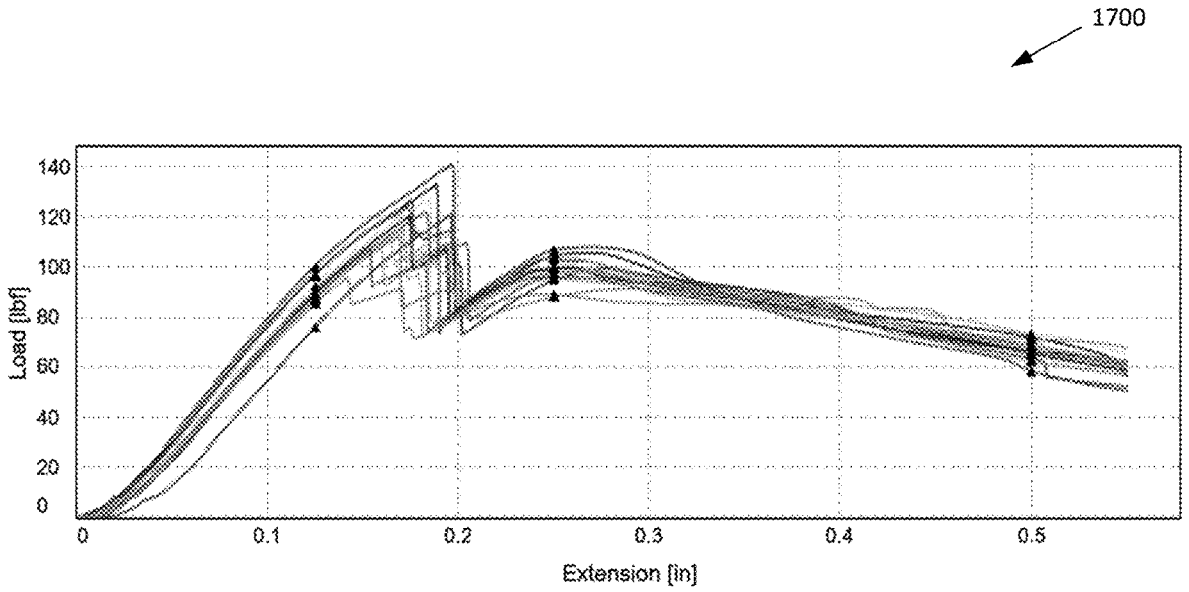
FIG. 26 (Prior Art)
FIG. 26 is a graph of test results of a conventional dispensing container showing the relationship between an applied load force and the resulting displacement or shortening of the dispensing container.

Table 3 below shows the results of 15 tests of a conventional canister made of PET material and having a straight wall body. The data in Table 3 is shown in the graph 1700 of FIG. 26, which is a graph of test results of a conventional, prior art, dispensing container as shown in FIGS. 1 and 2. The graph in FIG. 26 is showing the relationship between an applied load force and the resulting displacement or shortening of the canister body. The "Maximum Load" is the largest applied force (in lbf) that the canister body was able to support, and the "Displacement at Peak Load" is the distance that the canister body is compressed when the maximum load is supported. The other three columns show the measured applied force that is supported by the canister body when the canister body has been compressed those particular amounts (0.5 inches, 0.25 inches, and 0.125 inches). The bottom row of Table 3 is an average of the 15 tests. The average maximum load supported by the straight wall conventional canister was 119.5148 lbf, which was measured at an average compression of 0.17 inches. The average measured loads were: 90.79 lbf at 0.125 inches of compression; 98.26 lbf at 0.25 inches of compression; and 67.13 lbf at 0.5 inches of compression.

Referring to FIG. 26, the maximum load that is supported by the prior art canister occurs at compression distances less than or approximately at 0.2 inches. The early buckling of the prior art canister bodies are shown in the graph by the large drop in supported force that occurs in each line either just before or around the 0.2 inch compression mark. After the canister body buckles and resets, there is a slight additional increase in the amount of the applied load that is supported until it tapers off.

TABLE 3

| Sample # | Maximum Load (lbf) | Displacement at Peak Load (in) | Load at 0.5 in (lbf) | Load at 0.25 in (lbf) | Load at 0.125 in (lbf) |
|---|---|---|---|---|---|
| 1 | 120.98624 | 0.196 | 65.646 | 94.828 | 75.971 |
| 2 | 126.61306 | 0.176 | 65.124 | 103.675 | 97.416 |
| 3 | 122.66454 | 0.184 | 68.227 | 97.276 | 89.42 |
| 4 | 115.02647 | 0.172 | 62.106 | 97.454 | 88.506 |
| 5 | 133.33336 | 0.189 | 66.564 | 104.592 | 96.784 |
| 6 | 124.62819 | 0.175 | 63.312 | 99.767 | 96.726 |
| 7 | 127.52852 | 0.185 | 73.399 | 100.479 | 92.351 |
| 8 | 120.56251 | 0.175 | 71.799 | 99.27 | 89.636 |
| 9 | 141.50378 | 0.197 | 65.963 | 106.968 | 100.205 |
| 10 | 111.82342 | 0.165 | 68.403 | 97.253 | 87.817 |
| 11 | 107.46026 | 0.154 | 58.44 | 95.942 | 89.69 |
| 12 | 108.2588 | 0.16 | 68.916 | 95.364 | 87.033 |
| 13 | 96.49326 | 0.143 | 65.742 | 89.031 | 85.492 |
| 14 | 123.40403 | 0.17 | 72.179 | 103.928 | 96.801 |
| 15 | 112.4354 | 0.169 | 71.194 | 88.107 | 88.013 |
| Averages= | 119.5148 | 0.17 | 67.13 | 98.26 | 90.79 |

Table 4 below shows the results of 24 tests of a conventional canister having a straight wall body with 25% PCR material and having a 60.5-gram weight. The data in Table 4 is shown in the graph 1800 of FIG. 27, which is a graph of test results of another conventional, prior art, dispensing container, as shown in FIGS. 1 and 2, showing the relationship between an applied load force and the resulting displacement or shortening of the dispensing container. The bottom row of Table 4 is an average of the 24 tests. The average maximum load supported by this straight wall conventional canister was 152.145 lbf, which was measured at an average compression of 0.5 inches. The average measured load at 0.25 inches of compression was 124.444 lbf. The fact that the maximum supported applied load was at 0.5 inches of compression means that the canister body suffers significant damage before the maximum support load is reached. Once a canister body is damaged, the canister body cannot be remedied to remove the effects of damage, such as buckling.

Figure 27:
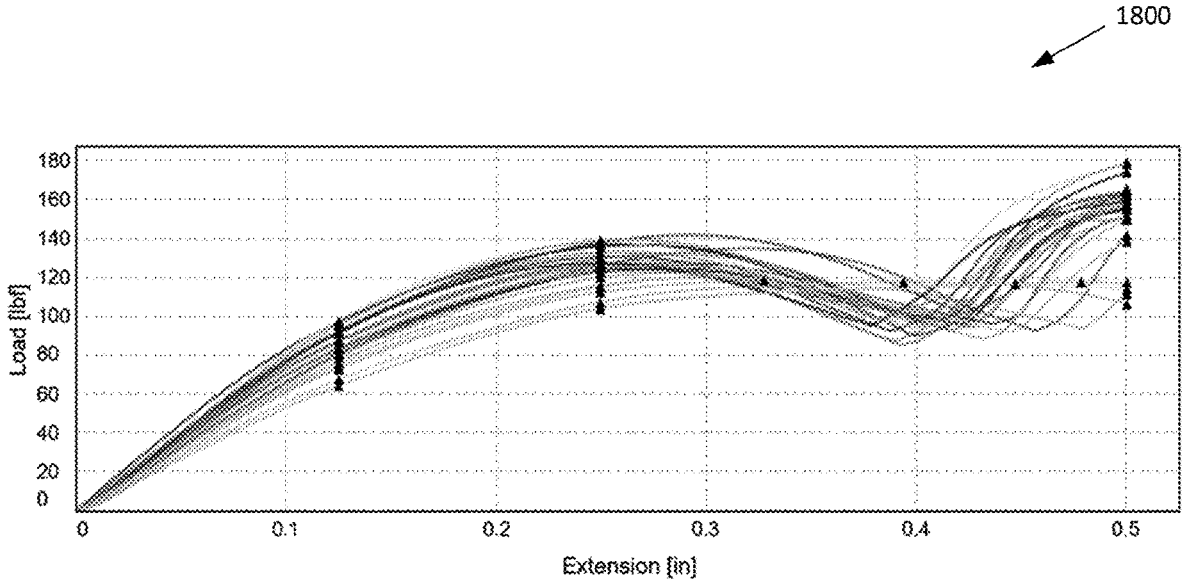
FIG. 27 (Prior Art)
FIG. 27 is a graph of test results of another conventional dispensing container showing the relationship between an applied load force and the resulting displacement or shortening of the dispensing container.

Referring to FIG. 27, the graph shows how conventional canisters respond to a maximum load test before and after buckling of the canister body. The maximum load that is supported by the canister occurs at the compression distance of 0.5 inches. This conventional canister shows how the applied load that is supported by the canister body has a drop and a reset before the maximum applied load is measured. The lines in FIG. 27 show the supported load increasing to a point until it starts decreasing to a lower point that reflects a reset and a buckling of the canister body. In both FIGS. 26 and 27, each of the conventional canisters suffers a buckling event, which causes damage to the canister body.

TABLE 4

| Sample # | Peak Load (lbf) | Displacement at Peak Load (in) | Load at 0.25 in (lbf) |
|---|---|---|---|
| 1 | 155.625 | 0.5 | 136.576 |
| 2 | 151.324 | 0.5 | 123.765 |
| 3 | 142.003 | 0.5 | 126.353 |
| 4 | 149.389 | 0.5 | 116.157 |
| 5 | 174.082 | 0.5 | 136.008 |
| 6 | 161.48 | 0.5 | 122.925 |
| 7 | 177.942 | 0.5 | 137.993 |
| 8 | 154.656 | 0.5 | 122.887 |
| 9 | 163.773 | 0.5 | 130.636 |
| 10 | 118.236 | 0.328 | 112.504 |
| 11 | 164.917 | 0.5 | 138.085 |
| 12 | 157.527 | 0.5 | 120.005 |
| 13 | 150.503 | 0.5 | 125.373 |
| 14 | 117.807 | 0.394 | 107.566 |
| 15 | 161.004 | 0.5 | 129.894 |
| 16 | 138.092 | 0.5 | 115.256 |
| 17 | 178.74 | 0.5 | 138.959 |
| 18 | 164.043 | 0.499 | 127.204 |
| 19 | 156.276 | 0.5 | 126.529 |
| 20 | 116.368 | 0.448 | 105.199 |
| 21 | 159.227 | 0.5 | 127.347 |
| 22 | 117.794 | 0.479 | 104.029 |
| 23 | 163.193 | 0.5 | 132.936 |
| 24 | 157.47 | 0.5 | 122.466 |
| Averages= | 152.145 | 0.5 | 124.444 |

Tables 5-7 below relate to different embodiments of shaped canisters according to the present disclosure. The tested shaped canisters have different weights—either 55 grams, 60 grams, or 65 grams. For each of the different canister weights, the test results include the measured Peak Load in lbf and the change in length (displacement) of the canister body when the Peak Load is measured. In addition, the test results include the supported load that is measured when the canister body is compressed at lengths of 0.125 inches, 0.25 inches, and 0.5 inches. Each of the canisters has a waist shaped canister body. The bottom row of each of Tables 5-7 is an average of the tests in that particular table.

The collective data in Tables 5-7 is shown in the graph 1900 shown in FIG. 28, which is a graph of test results of several different embodiments of waisted or shaped canisters according to the present disclosure showing the relationship between applied load forces and the resulting displacement or shortening of the canisters. In FIG. 28, none of the lines in graph 1900 has a sudden drop in supported force, such as the drops that were shown in FIGS. 26-27. Each of the supported weight lines in FIG. 28 has a gradual increase to a maximum supported load, and then a gradual decrease in the force that is supported by the canister. None of the tested shaped canisters buckles and suffers severe damage as it supports an applied force, which occurred in the conventional, prior art, canister as shown in FIGS. 26-27.

Initially referring to Table 5, these test results relate to a waisted canister body having a weight of 55 grams. An average peak load supported by the canister body is 152.445 lbf at a displacement (or compression) of 0.449 inches. The average load that the 55-gram canister body supports at a compression of 0.125 inches is 55.066 lbf. The 55-gram canister supported an average load of 108.832 at a compression of 0.25 inches. The average peak load occurred at 0.449 inches. The 55-gram canister supported an average load of 143.901 lbf at a compression of 0.5 inches.

TABLE 5

| Canister Weight (g) | Peak Load (lbf) | Displacement at Peak Load (in) | Load at 0.5 in (lbf) | Load at 0.25 in (lbf) | Load at 0.125 in (lbf) |
|---|---|---|---|---|---|
| 55 g | 165.824 | 0.441 | 152.023 | 117.373 | 62.447 |
| 55 g | 139.066 | 0.456 | 135.778 | 100.291 | 47.685 |
| Averages= | 152.445 | 0.449 | 143.901 | 108.832 | 55.066 |

Referring to Table 6, these test results relate to a waisted canister body having a weight of 60 grams. An average peak load supported by the canister body is 182.19 lbf at a displacement (or compression) of 0.375 inches. The average load that the 60-gram canister body supports at a compression of 0.125 inches is 70.621 lbf. The 60-gram canister supported an average load of 143.639 at a compression of 0.25 inches. The average peak load occurred at 0.375 inches. The 60-gram canister supported an average load of 138.334 lbf at a compression of 0.5 inches.

TABLE 6

| Canister Weight (g) | Peak Load (lbf) | Displacement at Peak Load (in) | Load at 0.5 in (lbf) | Load at 0.25 in (lbf) | Load at 0.125 in (lbf) |
|---|---|---|---|---|---|
| 60 g | 178.981 | 0.383 | 137.295 | 138.378 | 65.097 |
| 60 g | 185.399 | 0.367 | 139.373 | 148.9 | 76.145 |
| Averages= | 182.19 | 0.375 | 138.334 | 143.639 | 70.621 |

Referring to Table 7, these test results relate to a waisted canister body having a weight of 65 grams. An average peak load supported by the canister body is 215.075 lbf at a displacement (or compression) of 0.416 inches. The average load that the 65-gram canister body supports at a compression of 0.125 inches is 60.978 lbf. The 65-gram canister supported an average load of 120.288 at a compression of 0.25 inches. The average peak load occurred at 0.416 inches. The 65-gram canister supported an average load of 190.218 lbf at a compression of 0.5 inches.

TABLE 7

| Canister Weight (g) | Peak Load (lbf) | Displacement at Peak Load (in) | Load at 0.5 in (lbf) | Load at 0.25 in (lbf) | Load at 0.125 in (lbf) |
|---|---|---|---|---|---|
| 65 g | 216.677 | 0.405 | 176.679 | 122.145 | 65.222 |
| 65 g | 213.473 | 0.427 | 203.757 | 118.431 | 56.734 |
| Average= | 215.075 | 0.416 | 190.218 | 120.288 | 60.978 |

Table 8 below is summary of the average data in each of the Tables 3-7 described above, with each of the rows in Table 8 corresponding to each of the Tables 3-7, respectively. The columns from left to right are in order of increasing compression from 0.125 inches to 0.25 inches to 0.5 inches. The compression at which the maximum load is reached for each of the tested canisters is indicated relative to the 0.125 inches, 0.25 inches, and 0.5 inches.

TABLE 8

| | Compression of 0.125" - load (lbf) | Between 0.125" and 0.25" | Compression of 0.25" - load (lbf) | Between 0.25" and 0.5" | Compression of 0.5" - load (lbf) |
|---|---|---|---|---|---|
| Conventional Canister 1 - Table 3 | 90.79 | Max Load of 119.515 (lbf) @ 0.17" | 98.26 | | 67.13 |
| Conventional Canister 2 - Table 4 | N/A | | 124.444 | | Max Load of 152.145 (lbf) occurs @ 0.5" |
| Shaped Canister #1 - Table 5 | 55.066 | | 108.832 | Max Load of 152.445 (lbf) @ 0.449" | 143.901 |
| Shaped Canister #2 - Table 6 | 70.621 | | 143.639 | Max Load of 182.19 (lbf) @, 0.375" | 138.334 |
| Shaped Canister #3 - Table 7 | 60.978 | | 120.288 | Max Load of 215.075 (lbf) @ 0.416" | 190.218 |

Tables 2-8 above relate to the application of an external force on the top of a dispensing container or canister, and the measuring of when a maximum load is supported and at what compression to the length of the canister body. An external force can also be applied to a side of the canister body, and the side applied force can be located at different locations of the canister body. Referring to Table 9 below, a straight wall conventional canister and a narrow waist shaped canister were tested to see the maximum side load that the canisters can withstand at different locations. The side load can be applied to the neck, to the middle portion, and to the heel of the canisters. As shown, the shaped canister can support and withstand a larger side applied load applied than the conventional canister.

As shown in Table 9 below, the side loads for the shaped canister were higher than the conventional straight-wall canister. Additional testing was conducted and for the conventional straight-wall canisters, three out of five canisters had their closure mechanisms completely pop off due to an applied side force. The loss of the closure mechanism means that any liquid in the canister spills or leaks from the canister, which is a problem especially if the canister is in a shipping box or container. However, when the same applied side force was applied to shaped canisters, none of the five tested shaped canisters lost their closure mechanisms. As a result, each of the shaped canisters maintained the integrity of their seals.

The shaped canisters according to the present invention have narrowed portions, which results in less internal volume than the internal volume of a conventional straight wall canister. The improved performance of the shaped canisters in maintaining their closure mechanisms coupled to their bodies is due to at least two factors. First, the shaped configuration of the side wall of the canister body improves the resistance to a laterally applied force. Second, having less air in the shaped canister due to the narrowed portion means there is less air to be forced against the closure mechanism when the force impacts the canister body. Those factors lead to a drastic reduction in closure mechanisms popping off shaped canisters, and in the performed testing, none of the closure mechanisms popped off.

TABLE 9

| | Conventional Canister | Shaped Canister |
|---|---|---|
| Material | HDPE | HDPE |
| Shape | Straight Wall | Narrow Waist and Outer Texture |

TABLE 9-continued

| | Conventional Canister | Shaped Canister |
|---|---|---|
| Side Load - Neck | 7.85 lbf | 9.18 lbf |
| Side Load - Middle | 5.58 lbf | 8.317 lbf |
| Side Load - Heel | 11.76 lbf | 13.31 lbf |

Additional side load testing was performed on both a conventional straight wall canister and a shaped canister according to the present disclosure. Tables 10A, 10B, and 10C below are related tables that show the test results for side load forces applied to the neck, middle, and heel, respectively, of a conventional straight wall canister. Table 10A includes test results for side loads applied to a conventional canister neck, with the peak load measured and the lateral displacement at which the peak load was measured. The measured load averages were 8.512 lbf and 8.384 lbf. Table 10B includes test results for side loads applied to a conventional canister middle, with the peak load measured and the lateral displacement at which the peak load was measured. The measured load averages were 5.14 lbf and 4.922 lbf. Table 10C includes test results for side loads applied to the heel at the bottom of the conventional canister, with the peak load measured and the lateral displacement at which the peak load was measured. The measured load averages were 7.673 lbf and 12.749 lbf.

TABLE 10A

| Neck (Top of Canister) | | | | | | | |
|---|---|---|---|---|---|---|---|
| SIDE 1 | | | | SIDE 2 | | | |
| | Peak Load (lbf) | Displacement at Peak Load (in) | Load at 0.50 in (lbf) | | Peak Load (lbf) | Displacement at Peak Load (in) | Load at 0.50 in (lbf) |
| 1 | 8.358 | 0.5 | 8.358 | 1 | 8.225 | 0.491 | 8.22 |
| 2 | 8.561 | 0.5 | 8.561 | 2 | 8.308 | 0.5 | 8.308 |
| 3 | 8.641 | 0.5 | 8.641 | 3 | 8.594 | 0.5 | 8.594 |
| 4 | 8.475 | 0.5 | 8.475 | 4 | 8.18 | 0.5 | 8.179 |
| 5 | 8.741 | 0.5 | 8.74 | 5 | 8.921 | 0.5 | 8.921 |
| 6 | 8.49 | 0.5 | 8.49 | 6 | 8.021 | 0.5 | 8.021 |
| 7 | 8.9 | 0.5 | 8.9 | 7 | 8.773 | 0.5 | 8.773 |
| 8 | 8.611 | 0.5 | 8.611 | 8 | 8.145 | 0.5 | 8.145 |
| 9 | 8.642 | 0.5 | 8.642 | 9 | 8.735 | 0.5 | 8.735 |
| 10 | 8.524 | 0.5 | 8.524 | 10 | 8.126 | 0.5 | 8.126 |
| 11 | 8.719 | 0.5 | 8.718 | 11 | 8.959 | 0.5 | 8.958 |
| 12 | 8.754 | 0.5 | 8.754 | 12 | 8.085 | 0.5 | 8.085 |
| 13 | 8.1 | 0.5 | 8.1 | 13 | 8.16 | 0.5 | 8.16 |
| 14 | 8.58 | 0.5 | 8.58 | 14 | 8.18 | 0.5 | 8.18 |
| 15 | 8.337 | 0.499 | 8.334 | 15 | 8.737 | 0.5 | 8.736 |
| 16 | 8.432 | 0.5 | 8.432 | 16 | 8.022 | 0.5 | 8.022 |
| 17 | 7.684 | 0.5 | 7.684 | 17 | 8.589 | 0.5 | 8.589 |
| 18 | 8.527 | 0.5 | 8.525 | 18 | 8.341 | 0.5 | 8.341 |
| 19 | 8.306 | 0.5 | 8.306 | 19 | 8.32 | 0.5 | 8.319 |
| 20 | 8.609 | 0.5 | 8.609 | 20 | 8.127 | 0.5 | 8.127 |
| 21 | 8.753 | 0.5 | 8.753 | 21 | 8.643 | 0.5 | 8.643 |
| 22 | 8.492 | 0.5 | 8.492 | 22 | 8.311 | 0.5 | 8.311 |
| 23 | 8.539 | 0.5 | 8.539 | 23 | 8.677 | 0.5 | 8.677 |
| Mean | 8.512 | 0.5 | 8.512 | 24 | 8.051 | 0.5 | 8.051 |
| | | | | Mean | 8.385 | 0.5 | 8.384 |

TABLE 10B

| Middle (Middle of Canister) | | | | | | | |
|---|---|---|---|---|---|---|---|
| SIDE 1 | | | | SIDE 2 | | | |
| | Peak Load (lbf) | Displacement at Peak Load (in) | Load at 0.50 in (lbf) | | Peak Load (lbf) | Displacement at Peak Load (in) | Load at 0.50 in (lbf) |
| 1 | 5.425 | 0.5 | 5.423 | 1 | 5.414 | 0.5 | 5.414 |
| 2 | 4.836 | 0.499 | 4.831 | 2 | 4.13 | 0.5 | 4.13 |
| 3 | 4.916 | 0.5 | 4.916 | 3 | 4.907 | 0.5 | 4.907 |
| 4 | 4.668 | 0.5 | 4.668 | 4 | 3.636 | 0.5 | 3.635 |
| 5 | 4.907 | 0.5 | 4.907 | 5 | 4.89 | 0.499 | 4.888 |
| 6 | 5.005 | 0.5 | 5.005 | 6 | 3.883 | 0.5 | 3.883 |
| 7 | 5.06 | 0.5 | 5.06 | 7 | 4.823 | 0.5 | 4.823 |
| 8 | 4.467 | 0.499 | 4.466 | 8 | 4.237 | 0.5 | 4.237 |
| 9 | 5.637 | 0.499 | 5.634 | 9 | 5.578 | 0.499 | 5.576 |
| 10 | 5.538 | 0.5 | 5.538 | 10 | 5.053 | 0.5 | 5.051 |
| 11 | 5.016 | 0.5 | 5.016 | 11 | 4.717 | 0.5 | 4.717 |
| 12 | 4.542 | 0.5 | 4.542 | 12 | 4.165 | 0.499 | 4.16 |
| 13 | 5.774 | 0.5 | 5.773 | 13 | 6.19 | 0.5 | 6.19 |
| 14 | 6.013 | 0.499 | 6.012 | 14 | 5.361 | 0.5 | 5.36 |
| 15 | 4.909 | 0.5 | 4.908 | 15 | 4.964 | 0.5 | 4.964 |
| 16 | 4.76 | 0.5 | 4.76 | 16 | 4.399 | 0.5 | 4.399 |
| 17 | 4.704 | 0.5 | 4.704 | 17 | 4.841 | 0.5 | 4.841 |
| 18 | 4.74 | 0.5 | 4.74 | 18 | 4.112 | 0.5 | 4.112 |
| 19 | 6.017 | 0.5 | 6.017 | 19 | 6.424 | 0.5 | 6.423 |
| 20 | 5.696 | 0.5 | 5.696 | 20 | 5.553 | 0.499 | 5.546 |
| 21 | 5.759 | 0.5 | 5.759 | 21 | 6.21 | 0.499 | 6.209 |
| 22 | 5.701 | 0.499 | 5.699 | 22 | 5.465 | 0.5 | 5.465 |
| 23 | 4.342 | 0.5 | 4.342 | 23 | 5.021 | 0.5 | 5.021 |
| 24 | 4.949 | 0.5 | 4.949 | 24 | 4.178 | 0.5 | 4.177 |
| Mean | 5.141 | 0.5 | 5.14 | Mean | 4.923 | 0.5 | 4.922 |

TABLE 10C

| Heel (Bottom of Canister) | | | | | | | |
|---|---|---|---|---|---|---|---|
| SIDE 1 | | | | SIDE 2 | | | |
| | Peak Load (lbf) | Displacement at Peak Load (in) | Load at 0.25 in (lbf) | | Peak Load (lbf) | Displacement at Peak Load (in) | Load at 0.25 in (lbf) |
| 1 | 6.903 | 0.25 | 6.903 | 1 | 15.055 | 0.25 | 15.054 |
| 2 | 8.488 | 0.25 | 8.488 | 2 | 11.752 | 0.25 | 11.751 |
| 3 | 6.814 | 0.25 | 6.814 | 3 | 13.938 | 0.25 | 13.938 |
| 4 | 9.777 | 0.25 | 9.777 | 4 | 11.476 | 0.25 | 11.475 |
| 5 | 7.077 | 0.25 | 7.077 | 5 | 16.525 | 0.25 | 16.525 |
| 6 | 8.456 | 0.25 | 8.455 | 6 | 11.003 | 0.25 | 11.003 |
| 7 | 7.366 | 0.25 | 7.366 | 7 | 18.431 | 0.25 | 18.431 |
| 8 | 8.699 | 0.25 | 8.698 | 8 | 12.191 | 0.25 | 12.191 |
| 9 | 7.526 | 0.25 | 7.526 | 9 | 15.245 | 0.25 | 15.244 |
| 10 | 6.977 | 0.25 | 6.977 | 10 | 8.414 | 0.25 | 8.414 |
| 11 | 7.506 | 0.25 | 7.506 | 11 | 16.14 | 0.25 | 16.14 |
| 12 | 9.007 | 0.25 | 9.007 | 12 | 10.345 | 0.25 | 10.344 |
| 13 | 6.842 | 0.25 | 6.842 | 13 | 16.519 | 0.25 | 16.519 |
| 14 | 6.275 | 0.25 | 6.275 | 14 | 8.151 | 0.25 | 8.15 |
| 15 | 7.616 | 0.25 | 7.615 | 15 | 16.789 | 0.25 | 16.789 |
| 16 | 8.845 | 0.25 | 8.844 | 16 | 10.086 | 0.25 | 10.086 |
| 17 | 7.894 | 0.25 | 7.894 | 17 | 13.793 | 0.25 | 13.793 |
| 18 | 9.403 | 0.25 | 9.403 | 18 | 10.585 | 0.25 | 10.585 |
| 19 | 6.7 | 0.25 | 6.7 | 19 | 13.139 | 0.25 | 13.139 |
| 20 | 6.188 | 0.25 | 6.187 | 20 | 7.743 | 0.25 | 7.743 |
| 21 | 7.286 | 0.25 | 7.286 | 21 | 15.175 | 0.25 | 15.175 |
| 22 | 6.62 | 0.25 | 6.62 | 22 | 7.95 | 0.25 | 7.95 |
| 23 | 7.166 | 0.25 | 7.166 | 23 | 14.568 | 0.25 | 14.568 |
| 24 | 8.717 | 0.25 | 8.717 | 24 | 10.961 | 0.25 | 10.961 |
| Mean | 7.673 | 0.25 | 7.673 | Mean | 12.749 | 0.25 | 12.749 |

Several shaped canisters according to the present disclosure were also tested with side loads applied thereto. One shaped canister weighed 55 grams, another shaped canister weighed 60 grams, and the other shaped canister weighed 65 grams. Each of those shaped canisters had a side load applied to its neck, its middle, and its heel.

Table 11 below has the test results for the 55-gram shaped canister. The measured peak load average for a side load at the neck was 7.543 lbf, which was measured at an average displacement of 0.5 inches. The measured peak load average for a side load at the middle was 5.351, which was measured at an average displacement of 0.5 inches. The measured peak load average for a side load at the heel was 11.376, which was measured at an average displacement of 0.25 inches.

TABLE 11

| SHAPED CANISTER SIDE LOAD - 55g | | | |
|---|---|---|---|
| | Peak Load (lbf) | Displacement at Peak Load (in) | Load at 0.5 in (lbf) |
| NECK | | | |
| 55 g | 7.521 | 0.5 | 7.521 |
| 55 g | 7.564 | 0.5 | 7.564 |
| Avg | 7.543 | 0.5 | 7.543 |
| MIDDLE | | | |
| 55 g | 5.417 | 0.5 | 5.416 |
| 55 g | 5.286 | 0.5 | 5.286 |
| Avg | 5.352 | 0.5 | 5.351 |
| HEEL | | | |
| | Peak Load (lbf) | Displacement at Peak Load (in) | Load at 0.25 in (lbf) |
| 55 g | 9.822 | 0.25 | 9.821 |
| 55 g | 12.93 | 0.25 | 12.93 |
| Avg | 11.376 | 0.25 | 11.376 |

Table 12 below has the test results for the 60-gram shaped canister. The measured peak load average for a side load at the neck was 8.246 lbf, which was measured at an average displacement of 0.5 inches. The measured peak load average for a side load at the middle was 7.724, which was measured at an average displacement of 0.5 inches. The measured peak load average for a side load at the heel was 13.656, which was measured at an average displacement of 0.25 inches.

TABLE 12

| SHAPED CANISTER SIDE LOAD - 60 g | | | |
|---|---|---|---|
| | Peak Load (lbf) | Displacement at Peak Load (in) | Load at 0.5 in (lbf) |
| NECK | | | |
| 60 g | 8.956 | 0.5 | 8.956 |
| 60 g | 9.4 | 0.5 | 9.4 |
| 60 g | 7.255 | 0.5 | 7.255 |
| 60 g | 7.374 | 0.5 | 7.374 |
| Avg | 8.246 | 0.5 | 8.246 |
| MIDDLE | | | |
| 60 g | 8.379 | 0.5 | 8.378 |
| 60 g | 8.255 | 0.5 | 8.255 |
| 60 g | 7.086 | 0.5 | 7.085 |
| 60 g | 7.179 | 0.5 | 7.179 |
| Avg | 7.725 | 0.5 | 7.724 |
| HEEL | | | |
| | Peak Load (lbf) | Displacement at Peak Load (in) | Load at 0.25 in (lbf) |
| 60 g | 13.916 | 0.25 | 13.916 |
| 60 g | 12.696 | 0.25 | 12.696 |
| 60 g | 14.134 | 0.25 | 14.133 |
| 60 g | 13.879 | 0.25 | 13.878 |
| Avg | 13.656 | 0.25 | 13.656 |

Table 13 below has the test results for the 65-gram shaped canister. The measured peak load average for a side load at the neck was 10.105 lbf, which was measured at an average displacement of 0.5 inches. The measured peak load average for a side load at the middle was 7.341, which was measured at an average displacement of 0.5 inches. The measured peak load average for a side load at the heel was 13.639, which was measured at an average displacement of 0.25 inches.

TABLE 13

| SHAPED CANISTER SIDE LOAD - 65 g | | | |
|---|---|---|---|
| | Peak Load (lbf) | Displacement at Peak Load (in) | Load at 0.5 in (lbf) |
| NECK | | | |
| 65 g | 9.727 | 0.5 | 9.727 |
| 65 g | 10.482 | 0.5 | 10.482 |
| Avg | 10.105 | 0.5 | 10.105 |
| MIDDLE | | | |
| 65 g | 7.42 | 0.5 | 7.42 |
| 65 g | 7.262 | 0.5 | 7.262 |
| Avg | 7.341 | 0.5 | 7.341 |
| HEEL | | | |
| | Peak Load (lbf) | Displacement at Peak Load (in) | Load at 0.25 in (lbf) |
| 65 g | 13.6 | 0.25 | 13.6 |
| 65 g | 13.677 | 0.25 | 13.677 |
| Avg | 13.639 | 0.25 | 13.639 |

Table 14 below shows the averages of the average values above aggregated for the 55-gram, 60-gram, and 65-gram canisters. For the average peak loads measured at the necks of the shaped canister in Tables 11-13, namely, average peak loads of 7.543, 8.246, and 10.105, the average peak load is 8.631 lbf. For the average peak loads measured at the middle of the shaped canisters in Tables 11-13, namely, average peak loads of 5.351, 7.724, and 7.341, the average peak load is 6.806 lbf. For the average peak loads measured at the heels of the shaped canisters in Tables 11-13, namely, average peak loads of 11.376, 13.656, and 13.639, the average peak load is 12.890 lbf.

TABLE 14

| SHAPED CANISTER SIDE LOAD - 55 g and 60 g and 65 g | | | |
|---|---|---|---|
| | Peak Load | Displacement at Peak Load | Load at 0.5 in |
| NECK | | | |
| Avg of Avg | 8.631 | 0.5 | 8.631 |
| MIDDLE | | | |
| Avg of Avg | 6.806 | 0.5 | 6.806 |
| HEEL | | | |
| | Peak Load | Displacement at Peak Load | Load at 0.25 in |
| Avg of Avg | 12.890 | 0.25 | 12.890 |

The test results in Tables 10A-10C and 11-14 show how the tested shaped canisters were able to support and withstand a larger peak force than the tested conventional straight wall canister. For the side loads applied to the necks of the canisters, the conventional straight wall canisters average peak loads of 8.512 and 8.384, which average to 8.448. The average of the shaped canister peak side loads at the neck is 8.631 (see Table 14). For the side loads applied to the middles of the canisters, the conventional straight wall canisters average peak loads of 5.14 and 4.922, which average to 5.031. The average of the shaped canister peak side loads at the middle is 6.806 (see Table 14). For the side loads applied to the heels of the canisters, the conventional straight wall canisters average peak loads of 7.673 and 12.749, which average to 10.211. The average of the shaped canister peak side loads at the middle is 12.890 (see Table 14). Thus, at each of the tested locations (the neck, the middle, and the heel) of the canisters, the shaped containers were able to support a larger peak load than the conventional straight wall containers.

In alternative embodiments, a waisted or shaped canister may have multiple narrowed diameter or waist portions. For example, one narrowed portion can be located at the middle of the canister body and a second narrowed portion can be located either above or below and spaced apart from the middle-narrowed portion. The outer surface of the canister body can be angled or tapered inwardly and outwardly between the spaced apart narrowed portions. In another embodiment, the canister may have three spaced apart narrowed portions that have inwardly and outwardly angled or tapered outer surface portions therebetween.

In an alternative embodiment, the upper portion of the container may have a textured outer configuration similar to any textured outer configuration of the lower portion of the container. In another embodiment, the textured configuration can be located on the upper portion of the container only and not on the lower portion of the container.

Like numbers refer to like elements throughout. The terminology used herein is for the purpose of describing particular embodiments only and is not intended to be limiting of the invention. Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art. Well-known functions or constructions may not be described in detail for brevity and/or clarity.

As used herein, the singular forms "a," "an," and "the" are intended to include the plural forms as well, unless the context clearly indicates otherwise. The terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y, phrases such as "between about X and Y" mean "between about X and about Y," and phrases such as "from about X to Y" mean "from about X to about Y."

It will be understood that when an element is referred to as being "on," "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. Also, references to a structure or feature that is disposed "adjacent" another feature may have portions that overlap or underlie the adjacent feature.

Spatially relative terms, such as "under," "below," "lower," "over," "upper," "lateral," "left," "right" and the like, may be used herein for ease of description to describe one element's or feature's relationship to another element or feature as illustrated in the figures. Spatially relative terms are intended to encompass different orientations of the disclosed structure in use or operation in addition to the orientation depicted in the figures. For example, if the structure in the figures is inverted, elements described as "under" or "beneath" other elements or features would then be oriented "over" the other elements or features. The device may be otherwise oriented (such as rotated 90 degrees) and the descriptors of relative spatial relationships used herein interpreted accordingly.

The term approximately or substantially may be construed to include +/−0.1% of the value that approximately or substantially is referencing.

As used herein, the terms "alternative," example," "exemplary," and derivatives thereof are intended to refer to non-limiting examples and/or variants embodiments discussed herein and are not intended to indicate preference for one or more embodiments compared to other embodiments. The invention being thus described, it will be apparent that the same may be varied in many ways. Such variations are not to be regarded as a departure from the spirit and scope of the invention, and all such modifications as would be obvious to one skilled in the art are to be included within the scope of the following claims.

What is claimed is:

1. A dispensing canister for wipes, the dispensing canister comprising:

a container including a body that defines a cavity in which wipes can be located, the body having a first end, a second end opposite to the first end, and an intermediate portion located between the first end and the second end, the body having an outer surface, the first end having a first outer diameter and a part of the intermediate portion having a second outer diameter, the second outer diameter being smaller than the first outer diameter, and the outer surface being tapered from the first outer diameter to the second outer diameter, the body having a longitudinal axis and a length extending along the longitudinal axis from the first end to the second end, the length of the body shortens when a sufficient force is applied to the first end, wherein when the length is compressed 0.125 inches, the body can support between 47 lbf and 77 lbf; and a closure that is removably coupleable to the container, wherein the closure can be closed to seal the cavity and opened to enable access to the cavity.

2. The dispensing canister of claim 1, wherein the second end has a third outer diameter, and the second outer diameter is less than the third outer diameter, and the outer surface between the second outer diameter and the third outer diameter being tapered.

3. The dispensing canister of claim 2, wherein the third outer diameter reduces a volume of air in the cavity and improves a resistance of the container to having the closure decouple from the body.

4. The dispensing canister of claim 1, wherein the container includes a neck portion proximate to the first end of the body, the closure is coupleable to the neck portion, the neck portion includes a first inner surface that defines an innermost portion of the neck portion and a first inner diameter, the intermediate portion includes a second inner surface that defines an innermost portion of the intermediate portion and a second inner diameter, and the second inner diameter is equal to or greater than the first inner diameter.

5. The dispensing canister of claim 1, wherein the body can support a maximum applied force between a shortening of the length by 0.25 inches and a shortening of the length by 0.5 inches.

6. The dispensing canister of claim 5, wherein the body supports its maximum applied load between a shortening of the length by 0.375 inches and a shortening of the length by 0.45 inches.

7. The dispensing canister of claim 5, wherein the body supports its maximum applied load at a shortening of the length by 0.375 inches.

8. The dispensing canister of claim 5, wherein the body supports a maximum applied load in a range between 152 lbf and 216 lbf.

9. The dispensing canister of claim 1, wherein when the length is compressed 0.25 inches, the body can support between 100 lbf and 149 lbf.

10. The dispensing canister of claim 9, wherein when the length is compressed 0.5 inches, the body can support between 135 lbf and 204 lbf.

11. The dispensing canister of claim 1, wherein over a range of the length of the body shortening between 0.0 inches and 0.5 inches in response to an applied force, the applied force that is supported by the body increases from 0 lbf to a maximum load point and then decreases without increasing a second time prior to the length of the body shortening 0.5 inches.

12. The dispensing canister of claim 1, wherein the body is made of high-density polyethylene.

13. The dispensing canister of claim 1, wherein the body has a weight in a range from 55 grams to 65 grams.

14. A dispensing canister for wipes, the dispensing canister comprising:

a container including a body that defines a cavity in which wipes can be located, the body including:

a first end having a first outer diameter;

a second end opposite to the first end, the second end having a second outer diameter;

an intermediate portion located between the first end and the second end, part of the intermediate portion having a third outer diameter, the third outer diameter being smaller than the first outer diameter and smaller than the second outer diameter;

an outer surface, the outer surface being tapered between the first outer diameter and the third outer diameter such that an outer diameter of the body decreases from the first outer diameter to the third outer diameter, and the outer surface being tapered between the second outer diameter and the third outer diameter such that an outer diameter of the body decreases from the second outer diameter to the third outer diameter; and a longitudinal axis and a length extending along the longitudinal axis from the first end to the second end, the length of the body shortens when a sufficient force is applied to the first end of the body, and the body can support a maximum applied force between a shortening of the length by 0.25 inches and a shortening of the length by 0.5 inches; and a closure that is removably coupleable to the container, wherein the closure can be closed to seal the cavity and opened to enable access to the cavity.

15. The dispensing canister of claim 14, wherein the body supports its maximum applied load between a shortening of the length by 0.36 inches and a shortening of the length by 0.46 inches.

16. The dispensing canister of claim 15, wherein the body supports a maximum applied load in a range between 139 lbf and 217 lbf.

17. The dispensing canister of claim 14, wherein the body is made of high-density polyethylene and has a weight in a range from 55 grams to 65 grams.

18. A dispensing canister for wipes, the dispensing canister comprising:

a container including a body that defines a cavity in which wipes can be located, the body including:

a first end having a first outer diameter;

a second end opposite to the first end, the second end having a second outer diameter;

an intermediate portion located between the first end and the second end, part of the intermediate portion having a third outer diameter, the third outer diameter being smaller than the first outer diameter and smaller than the second outer diameter;

a longitudinal axis extending from the first end to the second end, the body having a length extending along the longitudinal axis, the length of the body shortening when a sufficient force is applied to the first end of the body, wherein over a range of the length of the body shortening between 0.0 inches and 0.5 inches in response to an applied force, the applied force that is supported by the body increases from 0 lbf to a maximum load point and then decreases without increasing a second time prior to the length of the body shortening 0.5 inches; and an outer surface, the outer surface being tapered between the first outer diameter and the third outer diameter such that an outer diameter of the body decreases from the first outer diameter to the third outer diameter; and a closure that is removably coupleable to the container, wherein the closure can be closed to seal the cavity and opened to enable access to the cavity.

19. The dispensing canister of claim 18, wherein the body can support a maximum applied force between a shortening of the length by 0.25 inches and a shortening of the length by 0.5 inches.

20. The dispensing canister of claim 18, wherein the container includes a neck portion proximate to the first end of the body, the closure is coupleable to the neck portion, the neck portion includes a first inner surface that defines an innermost portion of the neck portion and a first inner diameter, the intermediate portion includes a second inner surface that defines an innermost portion of the intermediate portion and a second inner diameter, and the second inner diameter is equal to or greater than the first inner diameter.

* * * * *